US010273109B2

(12) United States Patent
Oguri et al.

(10) Patent No.: US 10,273,109 B2
(45) Date of Patent: Apr. 30, 2019

(54) PROCESSING APPARATUS AND STACKER DEVICE

(71) Applicant: Duplo Seiko Corporation, Kinokawa-shi, Wakayama (JP)

(72) Inventors: Kazuhito Oguri, Kinokawa (JP); Akihiko Toki, Kinokawa (JP); Kazuya Takitani, Kinokawa (JP); Tomoyuki Nagayama, Kinokawa (JP); Akane Tokutake, Kinokawa (JP)

(73) Assignee: Duplo Seiko Corporation, Kinokawa-shi, Wakayama (JP)

( * ) Notice: Subject to any disclaimer, the term of this patent is extended or adjusted under 35 U.S.C. 154(b) by 0 days.

(21) Appl. No.: 15/708,188

(22) Filed: Sep. 19, 2017

(65) Prior Publication Data

US 2018/0086586 A1 Mar. 29, 2018

(30) Foreign Application Priority Data

Sep. 21, 2016 (JP) ..... 2016-184319
Sep. 4, 2017 (JP) ..... 2017-169494

(51) Int. Cl.
*B65H 35/02* (2006.01)
*B65H 31/10* (2006.01)
(Continued)

(52) U.S. Cl.
CPC ..... *B65H 31/10* (2013.01); *B65H 31/3054* (2013.01); *B65H 33/16* (2013.01);
(Continued)

(58) Field of Classification Search
CPC .... B65H 35/02; B65H 35/0086; B65H 31/00; B65H 39/043; B65H 39/05; B65H 2301/5155; B41F 13/58
(Continued)

(56) References Cited

U.S. PATENT DOCUMENTS 1,815,744 A 7/1931 Sullivan
6,729,216 B2 * 5/2004 Schaede ..... B65H 29/041 83/151
(Continued)

FOREIGN PATENT DOCUMENTS

DE 2851257 A1 6/1980
JP 2001232700 A 8/2001
(Continued)

OTHER PUBLICATIONS

The extended European Search Report dated Feb. 15, 2018, by the European Patent Office in corresponding European Application No. 17191112.6. (12 pages).

*Primary Examiner* — Leslie A Nicholson, III
(74) *Attorney, Agent, or Firm* — Buchanan Ingersoll & Rooney PC

(57) ABSTRACT

A processing apparatus comprises: a conveyance part for conveying a sheet; a processing part including a processing member that is installed in a manner of being movable in an intersecting direction of intersecting with a conveyance direction of the conveyance part and that performs predetermined processing at a predetermined position of the sheet under conveyance; a stacker part for accumulating processing articles obtained by the processing of the processing part; and a control part for controlling the stacker part such as to sort a predetermined amount of precedently ejected ones of the processing articles from the subsequent ones of the processing articles among the processing articles ejected to the stacker part by the conveyance part.

17 Claims, 19 Drawing Sheets

(51) Int. Cl.

| | |
|---|---|
| ***B65H 39/043*** | (2006.01) |
| ***B65H 39/05*** | (2006.01) |
| ***B65H 31/30*** | (2006.01) |
| ***B65H 33/16*** | (2006.01) |
| ***B65H 39/06*** | (2006.01) |
| ***B65H 43/06*** | (2006.01) |
| *B26D 1/24* | (2006.01) |

(52) U.S. Cl.
CPC ..... *B65H 39/043* (2013.01); *B65H 39/05* (2013.01); *B65H 39/06* (2013.01); *B65H 43/06* (2013.01); *B26D 1/245* (2013.01); *B65H 2301/42172* (2013.01); *B65H 2511/30* (2013.01); *B65H 2701/1914* (2013.01)

(58) Field of Classification Search
USPC ... 270/5.02, 5.03, 21.1, 52.09, 52.17, 58.07, 270/58.09, 58.17, 58.14, 58.18; 101/226
See application file for complete search history.

(56) References Cited

U.S. PATENT DOCUMENTS 6,877,740 B2 * 4/2005 Michler ..... B65H 29/40 271/187
7,419,149 B2 * 9/2008 Oota ..... B23D 35/008 270/37
7,635,121 B2 * 12/2009 Dobashi ..... B65H 29/6645 270/12
7,766,315 B2 * 8/2010 Ishikawa ..... B65H 31/24 270/58.01
7,832,318 B2 * 11/2010 Oota ..... B23D 35/008 83/371
8,369,986 B2 * 2/2013 Doi ..... B65H 39/115 270/58.18
8,406,681 B2 * 3/2013 Miyake ..... B26F 1/02 270/58.08
8,714,538 B2 * 5/2014 Miyake ..... B65H 31/34 270/58.09
8,882,099 B2 * 11/2014 Lewalski ..... B65H 29/52 270/52.09
8,916,028 B2 * 12/2014 Ota ..... B65H 35/02 162/286
9,010,745 B2 * 4/2015 Fukuda ..... B65H 31/10 270/58.07
9,463,945 B2 * 10/2016 Herrmann ..... B65H 37/00
2005/0023746 A1 2/2005 Michler et al.
2016/0185557 A1 6/2016 Herrmann
2016/0200544 A1 7/2016 Herrmann

FOREIGN PATENT DOCUMENTS

JP 2014-201441 A 10/2014
JP 2015129029 A 7/2015

* cited by examiner

PROCESSING APPARATUS AND STACKER DEVICE

BACKGROUND OF THE INVENTION

Field of the Invention

The present invention relates to a processing apparatus and a stacker device.

Background Art

In the conventional art, a processing apparatus is known that performs processing on sheets and then ejects the obtained processing articles to a stacker part. The following Patent Document 1 discloses a technique of sorting and accumulating a plurality of processing articles into each amount of one booklet.

PRIOR ART REFERENCES

Patent Documents

[Patent Document 1] JP 2014-201441 A

SUMMARY OF THE INVENTION

Problems to be Solved by the Invention

Nevertheless, in the above-mentioned Patent Document 1, a processing member is not provided that can move in an intersecting direction of intersecting with the conveyance direction of the conveyance part. Then, it is difficult to appropriately sort and manage the processing articles obtained by processing performed by such a processing member.

An object of the present invention is to provide a processing apparatus capable of appropriately sorting and managing the processing articles.

Means for Solving the Problem

For the purpose of solving the above-mentioned problem, a processing apparatus of the present invention includes: a conveyance part for conveying a sheet; a processing part including a processing member that is installed in a manner of being movable in an intersecting direction of intersecting with a conveyance direction of the conveyance part and that performs predetermined processing at a predetermined position of the sheet under conveyance; a stacker part for accumulating processing articles obtained by the processing of the processing part; and a control part for controlling the stacker part such as to sort a predetermined amount of precedently ejected ones of the processing articles from the subsequent ones of the processing articles among the processing articles ejected to the stacker part by the conveyance part.

Further, the control part controls the stacker part such as to perform the sorting processing on the processing articles in accordance with the number of ejected sheets of the processing articles ejected to the stacker part.

Then, the control part, at the time of the sorting processing on the processing articles, controls the conveyance part such as to stop the ejection operation for the processing articles to the stacker part.

Further, the stacker part includes a placement part constructed such that the processing articles can be sorted and placed at different positions on a placement surface.

Further, the control part stores, into a storage device, information concerning the sorting processing on the processing articles performed in the stacker part.

Further, the placement part includes a belt conveyor constructed such that the processing articles are carried on a belt running in a circulated manner.

Further, the control part, at the time of the sorting processing on the processing articles, controls a drive part of the belt conveyor such as to change a running speed of the belt conveyor.

Further, the stacker part is constructed such that a running speed of the belt conveyor can be changed by a user. Furthermore, the control part stores the changed running speed of the belt conveyor into a storage device.

Further, the control part, when a predetermined time has elapsed since the time point of the sorting processing on the processing articles, controls the conveyance part such as to automatically resume the ejection operation for the subsequent ones of the processing articles to the stacker part.

Further, the control part, when a predetermined time has elapsed since the time point of the sorting processing on the processing articles, controls the conveyance part and the processing part such as to terminate the processing on the sheets.

Further, the stacker part includes plural kinds of carrying members whose carrying methods for the processing articles are different from each other. Then, the carrying members are installed near an ejection port for the processing articles in the apparatus body. Furthermore, the control part identifies the type of the carrying member installed in the stacker part and then controls the individual parts on the basis of the identification result.

Further, the sheets are provided with information concerning the sorting processing on the processing articles performed in the stacker part. Then, the control part controls the individual parts on the basis of the information concerning the sorting processing.

Further, the control part controls the processing part such that in a case that the processing position of the processing member is different for the precedent ones and for the subsequent ones of the processing articles to be processed in the sorting processing, the processing member located at a precedent processing position serving as the processing position for the processing articles to be precedently ejected to the stacker part may be moved to a reference position and then moved from the reference position to a subsequent processing position serving as the processing position for the subsequent ones of the processing articles so as to execute the processing or, alternatively, may be moved from the precedent processing position to the subsequent processing position so as to execute the processing and such that in a case that the processing position of the processing member is identical for the precedent ones and for the subsequent ones of the processing articles to be processed in the sorting processing, the subsequent processing may be started without moving the processing member located at the precedent processing position.

Further, the control part controls a movement drive part of the supply tray such that in a case that the processing position is different for the precedent ones and for the subsequent ones of the processing articles to be processed in the sorting processing, a supply tray for supplying the sheets to the conveyance path may be moved to a waiting position from a supplying position where the sheets can be supplied to the conveyance path and such that in a case that the processing position is identical for the precedent ones and for the subsequent ones of the processing articles to be processed in the sorting processing, the processing on the sheets may be started in a state that the supply tray is maintained at the supplying position.

Further, a stacker device of the present invention includes a stacker part for accumulating processing articles which are ejected from a processing apparatus provided with a conveyance part for conveying a sheet and with a processing part including a processing member that is installed in a manner of being movable in an intersecting direction of intersecting with a conveyance direction of the conveyance part and that performs predetermined processing at a predetermined position of the sheet under conveyance and which are obtained by the processing of the processing part. Then, a stacker control part is provided for controlling the stacker part such as to sort a predetermined amount of precedently ejected ones of the processing articles from the subsequent ones of the processing articles among the processing articles ejected by the conveyance part.

Further, a placement part is provided that is constructed such that the processing articles can be sorted and placed at different positions on a placement surface. Then, the stacker control part controls the placement part such that the placement part may be caused to operate in linkage with the operation of at least any one of the conveyance part and the processing part of the processing apparatus.

Further, a switching operation part is provided for switching whether the placement part is to be caused to operate in linkage with the operation of at least any one of the conveyance part and the processing part of the processing apparatus.

Effect of the Invention

According to the present invention, provided are: a processing part including a processing member that is installed in a manner of being movable in an intersecting direction of intersecting with a conveyance direction of the conveyance part and that performs predetermined processing at a predetermined position of the sheet under conveyance; and a control part for controlling the stacker part such as to sort a predetermined amount of precedently ejected ones of the processing articles from the subsequent ones of the processing articles among the processing articles ejected to the stacker part by the conveyance part. Thus, the processing articles obtained by the processing performed by the processing member can appropriately be sorted and managed so that the workability is improved.

Further, the control part controls the stacker part such as to perform the sorting processing on the processing articles in accordance with the number of ejected sheets of the processing articles ejected to the stacker part. In this case, the processing articles to be precedently sorted and the processing articles to be subsequently sorted can be contained in one sheet. Thus, a problem that in a case that sorting processing is performed in accordance with the number of not-yet processed sheets and that the processing articles in a required number of sheets are completed in a middle of one sheet, an unnecessary portion is cut off and discarded from the sheet is resolved so that the sheet can be saved.

Then, the control part, at the time of the sorting processing on the processing articles, controls the conveyance part such as to stop the ejection operation for the processing articles to the stacker part. In this case, the sorting processing can appropriately be performed.

Further, the stacker part includes a placement part constructed such that the processing articles can be sorted and placed at different positions on a placement surface. In this case, the sorting can easily be achieved on the placement part.

Further, the placement part includes a belt conveyor constructed such that the processing articles are carried on a belt running in a circulated manner. In this case, the sorting can easily be performed on the belt conveyor.

Further, the control part stores, into a storage device, information concerning the sorting processing on the processing articles performed in the stacker part. In this case, the sorting processing can be performed by using the information stored in the storage device so that the convenience is improved.

Further, the control part, at the time of the sorting processing on the processing articles, controls a drive part of the belt conveyor such as to change a running speed of the belt conveyor. In this case, when the belt conveyor is caused to run faster than in a case that the sorting is not performed, the sorting time can be reduced. Further, when the belt conveyor is caused to run slower than in a case that the sorting is not performed, the sorted processing articles stacked in a large amount can appropriately be conveyed.

Further, in the above-mentioned configuration, the stacker part is constructed such that the running speed of the belt conveyor can be changed by a user. Then, the control part stores the changed running speed of the belt conveyor into a storage part. In this case, the user's convenience is improved.

Further, the control part, when a predetermined time has elapsed since the time point of the sorting processing on the processing articles, controls the conveyance part such as to automatically resume the ejection operation for the subsequent ones of the processing articles to the stacker part. In this case, the processing can be resumed without the necessity of operation of the user so that the convenience is improved.

Further, the control part, when a predetermined time has elapsed since the time point of the sorting processing on the processing articles, controls the conveyance part and the processing part such as to terminate the processing on the sheets. In this case, the power consumption can be reduced.

Further, the control part identifies the type of the carrying member installed in the stacker part and then controls the individual parts on the basis of the identification result. In this case, the sorting processing can automatically be executed when a carrying member suitable for the sorting processing is installed in the stacker part, so that the convenience is improved.

Further, the control part controls the individual parts on the basis of the information concerning the sorting processing. In this case, the convenience is improved.

Further, the control part controls the processing part such that in a case that the processing position of the processing member is different for the precedent ones and for the subsequent ones of the processing articles to be processed in the sorting processing, the processing member located at a precedent processing position serving as the processing position for the processing articles to be precedently ejected to the stacker part may be moved to a reference position and then moved from the reference position to a subsequent processing position serving as the processing position for the subsequent ones of the processing articles so as to execute the processing or, alternatively, may be moved from the precedent processing position to the subsequent processing position so as to execute the processing and such that in a case that the processing position of the processing member is identical for the precedent ones and for the subsequent ones of the processing articles to be processed in the sorting processing, the subsequent processing may be started without moving the processing member located at the precedent processing position. In this case, the operation of moving the processing member can be simplified so that the processing time can be reduced.

Further, the control part controls a movement drive part of the supply tray such that in a case that the processing position is different for the precedent ones and for the subsequent ones of the processing articles to be processed in the sorting processing, the supply tray for supplying the sheets to the conveyance path may be moved to a waiting position from a supplying position where the sheets can be supplied to the conveyance path and such that in a case that the processing position is identical for the precedent ones and for the subsequent ones of the processing articles to be processed in the sorting processing, the processing on the sheets may be started in a state that the supply tray is maintained at the supplying position. In this case, the operation of moving the supply tray can be simplified so that the processing time can be reduced.

Further, the stacker device includes a stacker control part for controlling the stacker part such as to sort a predetermined amount of precedently ejected ones of the processing articles from the subsequent ones of the processing articles among the processing articles ejected by the conveyance part. Thus, the processing articles can appropriately be sorted and managed so that the workability is improved.

Further, a placement part is included that is constructed such that the processing articles can be sorted and placed at different positions on a placement surface. Then, the stacker control part controls the placement part such that the placement part may be caused to operate in linkage with the operation of at least any one of the conveyance part and the processing part of the processing apparatus. In this case, the operation of the stacker device can be in synchronization with the operation of the processing apparatus so that the working efficiency can be improved.

Further, a switching operation part is provided for switching whether the placement part is to be caused to operate in linkage with the operation of at least any one of the conveyance part and the processing part of the processing apparatus. In this case, selection of whether the processing apparatus and the stacker device are to be linked together can be performed in accordance with the usage situation of the apparatus.

DETAILED DESCRIPTION

First Embodiment

Figure 1:
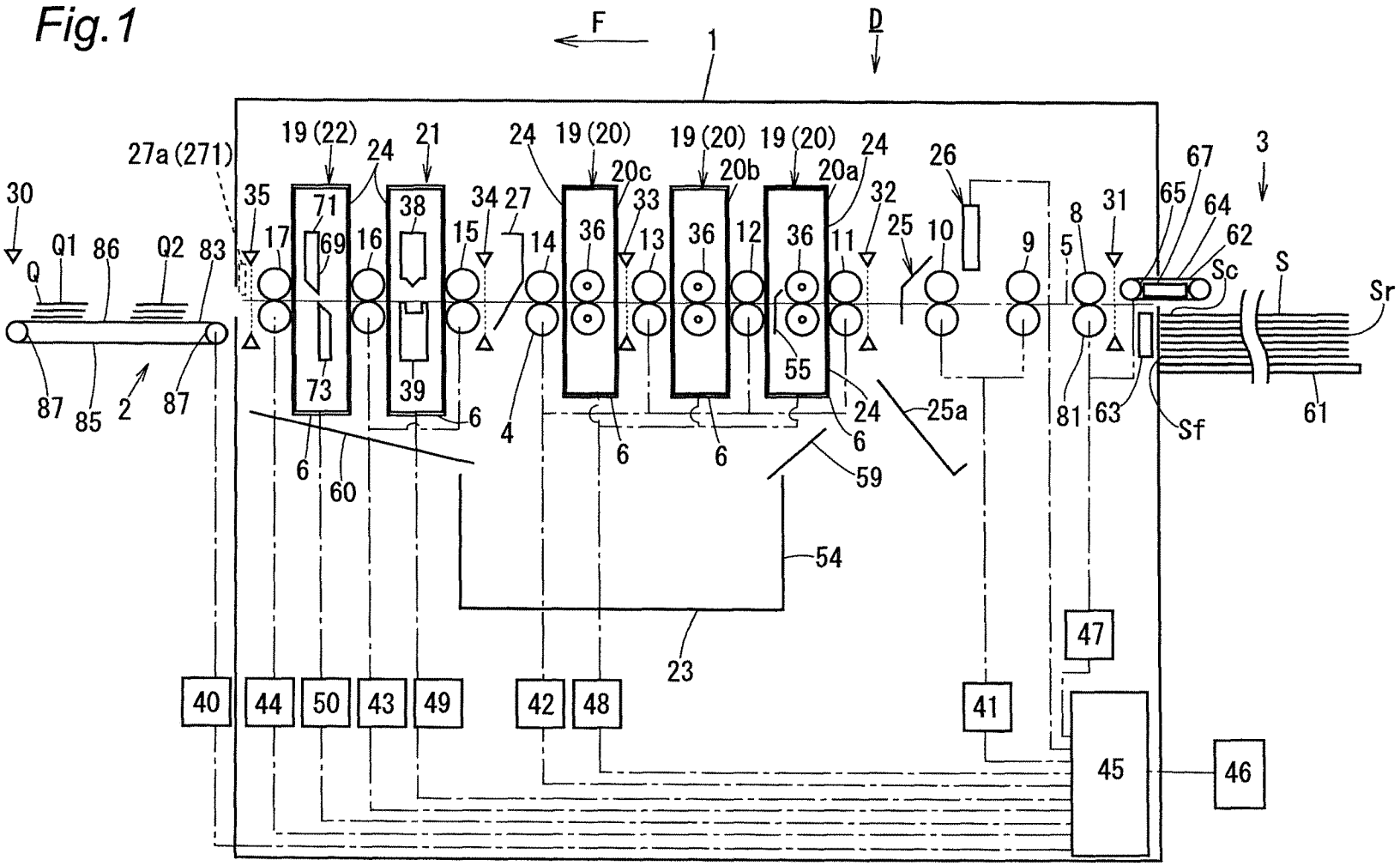
FIG. 1 is a schematic longitudinal sectional view of a processing apparatus according to an embodiment of the present invention.

A first embodiment of a processing apparatus according to the present invention is described below with reference to the drawings. Here, in the following description, a direction perpendicular to a conveyance direction F of a conveyance part 4 for conveying a sheet S is referred to as a width direction W. Further, the right side in a situation that the downstream is viewed from the upstream of the conveyance direction F is referred to as the right side of the apparatus. Similarly, the left side is referred to as the left side of the apparatus. FIG. 1 is a schematic longitudinal sectional view of a processing apparatus D according to the present invention. In FIG. 1, the processing apparatus D includes: a supply unit 3 provided at the upstream end of an apparatus body 1 in the conveyance direction F of the sheet S; a stacker part 2 for accumulating the processing articles Q, which is located at the downstream end in the conveyance direction F; and a conveyance path 5 substantially horizontally constructed between the supply unit 3 and the stacker part 2.

The conveyance path 5 includes a conveyance part 4 in which plural pairs each constructed from a pair of an upper and a lower conveyance roller 9 to 17 are installed. The conveyance rollers 9 to 17 are arranged individually with an interval in between in the conveyance direction F. The conveyance rollers 9 to 17 constituting the conveyance part 4 are respectively linked through a power transmission mechanism (not shown) to conveyance drive parts 41 to 44. Then, the conveyance drive parts 41 to 44 are electrically connected to a control part 45 individually.

The control part 45 incorporates a CPU and a storage device such as a RAM and a ROM. Then, an interface of the control part 45 is electrically connected to an operation panel 46 and a read unit 26. The operation panel 46 is constructed such as to serve as both a setting part and a display part which are used for setting various processing information including information concerning the cutting processing on the sheets S. Further, the read unit 26 also serves as the setting part.

In the conveyance path 5, processing parts 24 are installed for performing processing on the sheet S under conveyance. In FIG. 1, a cutting part 19 as well as a crease processing part 21 for forming a fold line perpendicular to the conveyance direction F are provided as the processing parts 24. The cutting part 19 is constructed from three slitter processing parts 20 and a cutter processing part 22.

Each of the slitter processing parts 20, the crease processing part 21, and the cutter processing part 22 is constructed in the form of an attachable and detachable unit and has a cassette configuration of being attachable and detachable at a desired position in the apparatus body 1. Thus, in accordance with the type of processing, the arrangement order of the individual processing parts 20, 21, and 22 may be changed. Alternatively, the individual processing parts 20, 21, and 22 may be replaced with other processing parts 24 such as a mechanism for performing crease processing along the conveyance direction F, a chamfering mechanism, and a perforation line forming mechanism. Further, these processing parts may be added.

The read unit 26 and a rejection mechanism 25 are arranged in the upstream of the slitter processing parts 20. Further, a scrap dropping mechanism 27 is arranged in the downstream of the slitter processing parts 20. Further, a scrap collecting part 23 is arranged in a lower part in the apparatus body 1.

In the conveyance path 5, a plurality of detection parts 31 to 35 of light transmission type are further arranged for detecting the front edge (the downstream edge) Sf or the rear end (the upstream edge) Sr of the sheet S or the processing article Q. Then, the detection parts 31 to 35 are electrically connected to an interface of the control part 45 individually. The first detection part 31 on the most upstream side in the conveyance direction F of the sheet S is arranged between a suction conveyance part 62 and feed rollers 8 of the supply unit 3. The second detection part 32 following this is arranged in a vicinity on the upstream side of the slitter processing parts 20. The third detection part 33 following this is arranged in a middle of the slitter processing parts 20. The fourth detection part 34 following this is arranged in a vicinity on the upstream side of the crease processing part 21. The fifth detection part 35 on the most downstream side is arranged in a vicinity on the upstream side of the stacker part 2.

The first detection part 31 detects: the front edge Sf of the sheet S at a stage that the sheet S under suction conveyance by the suction conveyance part 62 of the supply unit 3 is not yet gripped by the feed rollers 8; or the rear edge Sr of the sheet S being gripped and conveyed by the feed rollers 8. Then, with reference to the detected position of the sheet S, the position of the sheet S under conveyance on the conveyance path 5 at a later stage is calculated.

The second detection part 32 and the third detection part 33 detect clogging of the sheet S in the course of processing. The fourth detection part 34 is installed supplementarily for the purpose that even in a case that a long conveyance path 5 is employed so that a positional deviation (a conveyance error) in the conveyance direction F is accumulated in the sheet S in the course of processing on the conveyance path 5, the sheet position information obtained by the first detection part 31 may be corrected so that more accurate sheet position information may be acquired. The fifth detection part 35 detects ejection of the processing articles Q to the stacker part 2. Further, the fifth detection part 35 detects a jam or the like of the processing articles Q in the stacker part 2.

[Supply Unit 3]

The supply unit 3 includes a supply tray 61, the feed rollers 8, a suction conveyance part 62, and a separation air blowing part 63. The supply tray 61 is provided such that the sheets S are placed thereon and then the sheets S are supplied to the conveyance path 5. The supply tray 61 can go up and down by means of an elevating means (not shown). At the time of supplying the sheet S, the elevating means raises the supply tray 61 from a waiting position to a supplying position at a predetermined height where the uppermost sheet S can be suction-conveyed by the suction conveyance part 62 and then supplied to the conveyance path 5. Thus, the supply tray 61 can move between the waiting position and the supplying position. The elevating means serves as a drive part for moving the supply tray 61.

The feed rollers 8 are installed in the form of a pair of an upper and a lower roller. The suction conveyance part 62 includes a suction fan 67, a conveyance belt 64, and belt rollers 65. The supply unit 3 supplies a predetermined number of the sheets S placed on the supply tray 61, to the conveyance path 5 successively sheet by sheet from the top to the bottom by means of the suction conveyance part 62 and a pair of the upper and the lower feed roller 8.

The separation air blowing part 63 supplies air blow toward the front edges Sf of the sheets S on the supply tray 61 by means of a fan (not shown) so that the uppermost sheet S is separated from the plurality of sheets S placed thereon and is then suctioned and conveyed by the suction conveyance part 62. One belt roller 65 and the lower feed roller 81 among the feed rollers 8 are connected to a drive part 47 for paper feed. The separation air blowing part 63, the suction fan 67, the drive part 47 for paper feed are electrically connected to the control part 45.

[Read Unit 26]

Figure 6:
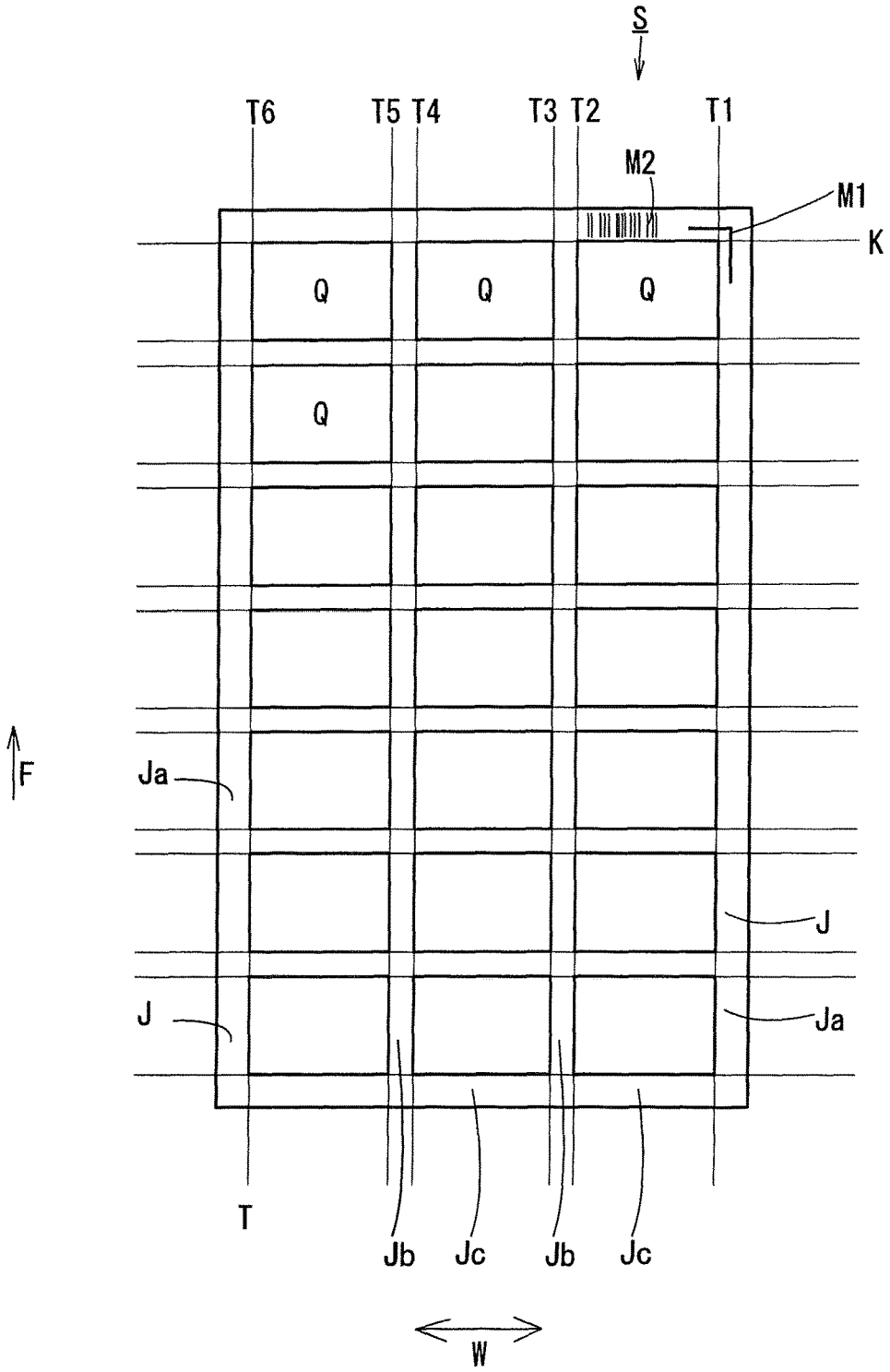
FIG. 6 is a plan view showing an example of a processing pattern of a sheet.

The read unit 26 reads an image of position mark M1 printed in a front corner of the sheet S as shown in FIG. 6 so as to detect the processing reference positions in the conveyance direction F of the sheet S and in the width direction W perpendicular to the conveyance direction F. Further, the read unit 26 may be constructed as a setting part for automatically reading processing information and then performing setup, apart from manual inputting of various processing information through the operation panel 46. Specifically, an image of bar code M2 printed in a front end part of the sheet S as shown in FIG. 6 is read so that various processing information to be applied to the sheet S is acquired. The read unit 26 is constructed from a CCD sensor or the like.

[Rejection Mechanism 25]

When the position mark M1 or the bar code M2 printed in the sheet S is indistinct and hence cannot be read by the read unit 26, the rejection mechanism 25 in FIG. 1 operates on the sheet S so as to drop and collect the unrecognizable sheet S into the tray 25*a*.

[Slitter Processing Part 20]

In the slitter processing parts 20, three units are arranged in the conveyance direction F. Then, in each unit, two sets of cutting blades 36 each consisting of an upper and a lower revolving type cutting blade are arranged with an interval in between in the width direction W. The cutting blades 36 are installed in a manner of being movable in an intersecting direction of intersecting with the conveyance direction F of the conveyance part 4 and serve as a processing part for performing predetermined processing at a predetermined position of the sheet S under conveyance. Any one of the cutting blades 36 on the upper side and the lower side of the conveyance path 5 is caused to revolve by a driving force of a revolution drive part 48 serving as a processing member drive part for driving the processing member and then the other cutting blade 36 is caused to follow and revolve so that cutting along the conveyance direction F of the conveyance part 4 is performed and thereby cutting lines T are formed in the sheet S.

In the most upstream unit 20*a*, a margin dropping member 55 is installed in the downstream of the cutting blades 36. In the most upstream unit 20*a*, mainly, unnecessary scraps Ja (see FIG. 6) located at both right and left edges of the sheet S can be cut off. The margin dropping member 55 guides the scraps Ja located at both right and left edges having been cut off by the cutting blades 36, so as to cause to fall into the scrap collecting part 23.

Figure 2:
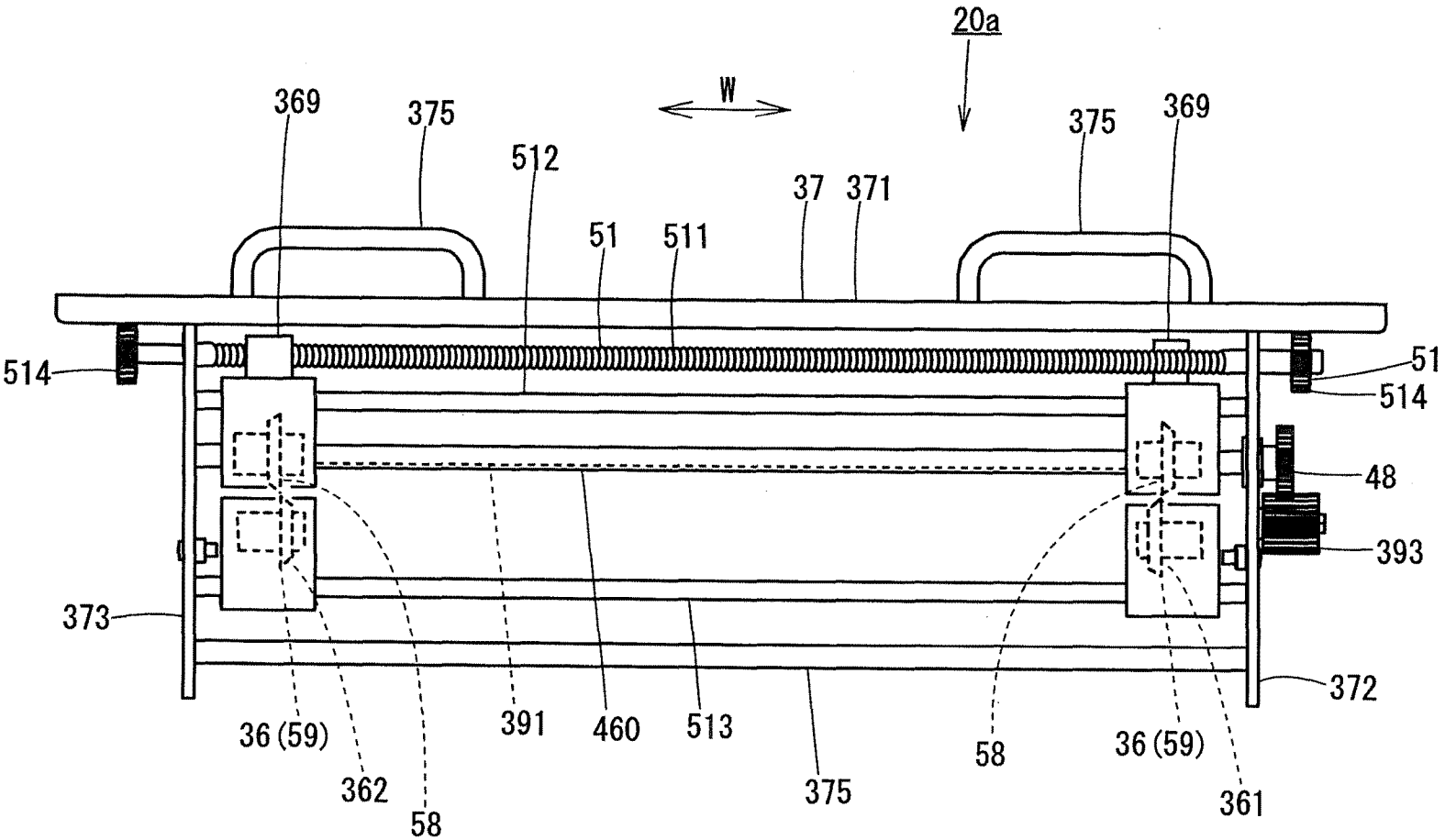
FIG. 2 is a view of a slitter processing part located in the most upstream of the processing apparatus, viewed from upstream.

FIG. 2 is a front view of the most upstream unit 20*a* among the slitter processing parts 20, viewed from the upstream of the conveyance direction F. The most upstream unit 20*a* includes a frame 37, the cutting blades 36, the revolution drive part 48, and a moving part 51. The frame 37 is constructed from a top plate 371, a pair of right and left side plates 372 and 373, and a bottom plate 375. Two handles 375 are attached to the upper face of the top plate 371. The side plates 372 and 373 are provided such as to extend vertically downward from positions near both sides of the top plate 371.

Figure 3:
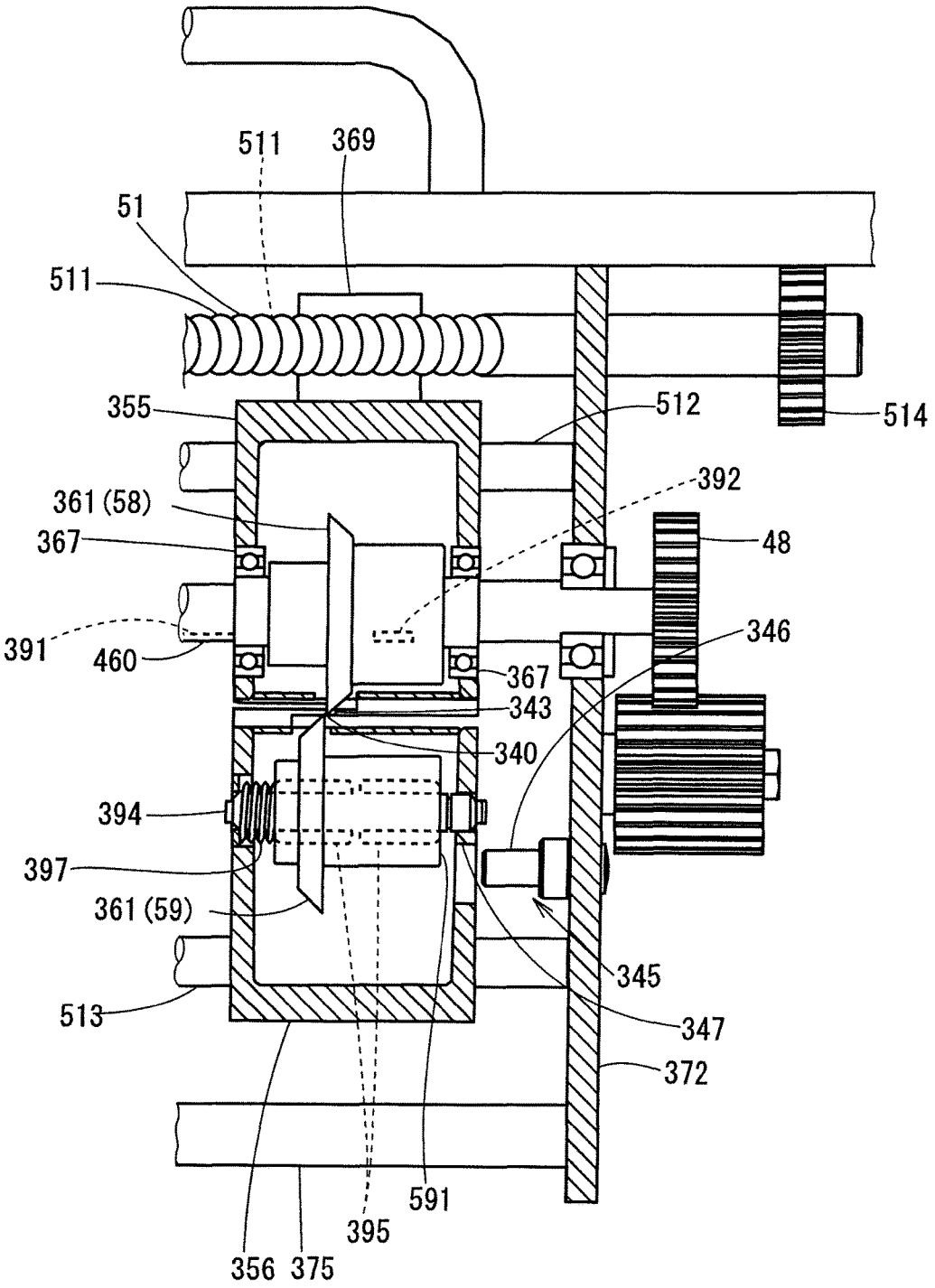
FIG. 3 is an enlarged view of cutting blades of the slitter processing part and of a periphery thereof.

The cutting blades 36 are each provided in the form of a pair of a left and a right blade and is movable in the width direction W in the inside of the frame 37 by means of the moving part 51. FIG. 3 shows in an enlarged manner an internal structure of the cutting blade 361 shown on the right side in FIG. 2. As shown in FIG. 3, the right side cutting blade 361 consists of a driver cutting blade 58 and a follower cutting blade 59 arranged opposite to each other in the up and down directions. Then, the driver cutting blade 58 and the follower cutting blade 59 are lapped together so that the cutting blade 361 achieve the cutting of the sheet S.

The driver cutting blade 58 is held in a box-shaped upper holder 355. In the upper holder 355, an opening part through which the driver cutting blade 58 protrudes is provided in a lower part. The upper holder 355 pivotally supports both the right and the left end of the driver cutting blade 58 in a revolvable manner through bearings 367. A screwing part 369 is provided in an upper part of the upper holder 355. The screwing part 369 is screwed onto the threaded shaft 511. Here, the threaded shaft 511 constitutes the moving part 51 and is bridged between the right and the left side plates 372 and 373. A drive shaft 460 is inserted along the center of revolution of the driver cutting blade 58. The drive shaft 460 constitutes the revolution drive part 48. A key groove 391 concave upward is formed along the longitudinal direction in a lower part of the drive shaft 460. Then, a key 392 fixed to the driver cutting blade 58 engages with the key groove 391. By virtue of the key 392 and the key groove 391, the driver cutting blade 58 is slidable along the width direction W corresponding to the longitudinal direction of the drive shaft 460 and, further, the driver cutting blade 58 revolves in association with the revolution of the drive shaft 460.

The follower cutting blade 59 is held in a revolvable manner in a box-shaped lower holder 356 whose upper part has an opening part through which the follower cutting blade 59 protrudes. A support shaft 394 is inserted along the center of revolution of the follower cutting blade 59. The support shaft 394 is fixed to the lower holder 356 and then pivotally supports the follower cutting blade 59 through slide bearings 395. By virtue of the slide bearings 395, the follower cutting blade 59 is revolvable relative to the support shaft 394 and slidable in the width direction W. A biasing part 397 is provided between the left wall inner face of the lower holder 356 in FIG. 3 and the left side end face of the follower cutting blade 59. The biasing part 397 is constructed from a helical spring. Then, the helical spring is fit onto the support shaft 394. The biasing part 397 biases the follower cutting blade 59 toward the driver cutting blade 58 such that both cutting blades 36 consisting of the driver cutting blade 58 and the follower cutting blade 59 may go into pressure contact with each other.

The lower holder 356 is linked to the upper holder 355 by a linkage part 343. The linkage part 343 links the lower face right portion of the upper holder 355 in FIG. 3 to the upper face left portion of lower holder 35 in the downstream of a pressure contact part 340 between the driver cutting blade 58 and the follower cutting blade 59. By virtue of this, the lower holder 356 is linked to the upper holder 355 and then moved in the width direction W in association with the movement of the upper holder 355 in the width direction W.

Then, the cutting blade 36 include a separation moving part 345 as shown in FIG. 3. The separation moving part 345 causes the pair of cutting blades 36, that is, the driver cutting blade 58 and the follower cutting blade 59, to be separated from each other when any one or both of the right and the left cutting blades 36 are not used for cutting the sheet S. When cutting processing by using all cutting blades 36 of the slitter processing part 19 is not necessary according to the processing information of the sheet S so that the cutting blades 36 are located at a waiting position where the cutting processing on the sheet S is not performed, the separation moving part 345 causes the driver cutting blade 58 and the follower cutting blade 59 to be separated from each other. The separation moving part 345 includes a pressing member 346. The pressing member 346 presses the driver cutting blade 58 or the follower cutting blade 59 in a direction causing separation from each other, in any one or both of the cutting blades 36 among the pair of cutting blades 36.

The pressing member 346 of the separation moving part 345 located on the right side when viewed from upstream in FIG. 3 is fixed to the right side plate 372 located near the waiting position of the cutting blade 361. The pressing member 346 is constructed in the form of a bar-shaped member protruding inward, that is, leftward in FIG. 3, from the right side plate 372 substantially at the same height position as the installation height of the follower cutting blade 59. In the lower holder 356, an opening part 347 for pressing is formed at a position opposite to the pressing member 346.

In association with the revolution of the threaded shaft 511, the upper and the lower holder 365 and 366 that hold the cutting blade 36 not used for the cutting are moved from the processing position to the waiting position. After that, the pressing member 346 is inserted into the opening part 347 for pressing so that the pressing member 346 goes into contact with the side face of a trunk part 591 of the follower cutting blade 59, that is, with the lower part of the right side surface of the trunk part 591 of the follower cutting blade 59 in FIG. 3. Then, when the threaded shaft 511 revolves further, the follower cutting blade 59 is pressed by the pressing member 346 against the biasing force of the biasing part 397 so as to be separated from the driver cutting blade 58. By virtue of this, in the follower cutting blade 59, the pressure contact with the blade edge of the driver cutting blade 58 caused by the biasing part 397 is released so that both blades becomes out of contact with each other and hence wearing is reduced.

The cutting blade 362 on the left side in FIG. 2 has substantially the same configuration as the right side cutting blade 361. However, the left-right orientation is symmetric to each other.

In FIG. 2, the revolution drive part 48 includes: a power transmission mechanism 393 constructed from one drive shaft 460, gear wheels, a belt, and the like; and a revolution driving source constructed from a motor or the like (not shown). The drive shaft 460 is bridged between the right and the left side plates 372 and 373 and inserted along the center of revolution of both the right and the left driver cutting blade 58. The power transmission mechanism 393 is installed in the outside of the right side plate 372. Then, the revolution driving source is installed on the apparatus body 1 side. Then, when the unit 20*a* is attached to the apparatus body 1, the driving force of the revolution driving source is transmitted to the power transmission mechanism 393 so as to revolve the drive shaft 460 and thereby revolve both the right and the left driver cutting blade 58 simultaneously.

The moving part 51 causes the cutting blade 36 serving as a processing member to move among the processing position, the reference position, and the waiting position. The moving part 51 includes: two threaded shafts 511, one upper guide shaft 512, one lower guide shaft 513, a pair of a left and a right gear 514, and two cutting blade movement drive parts (not shown) serving as processing member movement drive parts (not shown). The four shafts consisting of the threaded shafts 511, the upper guide shaft 512, and the lower guide shaft 513 are all bridged between the right and the left side plates 372 and 373. The two threaded shafts 511 are installed in parallel to each other in the upstream and the downstream of the conveyance direction of the sheet S.

The upstream threaded shaft 511 is screwed through the screwing part 369 of the cutting blade 362 located on the left side in FIG. 2. Then, in the upstream threaded shaft 511, a gear 514 is provided in the end part protruding outward beyond the left side plate 373. On the other hand, the downstream threaded shaft 511 is screwed through the screwing part 369 of the cutting blade 361 located on the right side in FIG. 2. Then, in the downstream threaded shaft 511, a gear 514 is provided in the end part protruding outward beyond the right side plate 372. The processing member movement drive part constructed from a motor or the like is installed on the apparatus body 1 side. When the unit 20 is attached to a receiving part 6 of the apparatus body, the right and the left gear 514 are individually linked to the two processing member movement drive parts on the apparatus body 1 side. Then, in association with the driving of each processing member movement drive part, each of the two threaded shafts 511 is independently revolved through the gear 514 by a predetermined amount so that the upper and the lower holder 365 and 366 of each cutting blade 36 are moved to and stopped at the processing position where the processing is performed on the sheet S.

Figure 4:
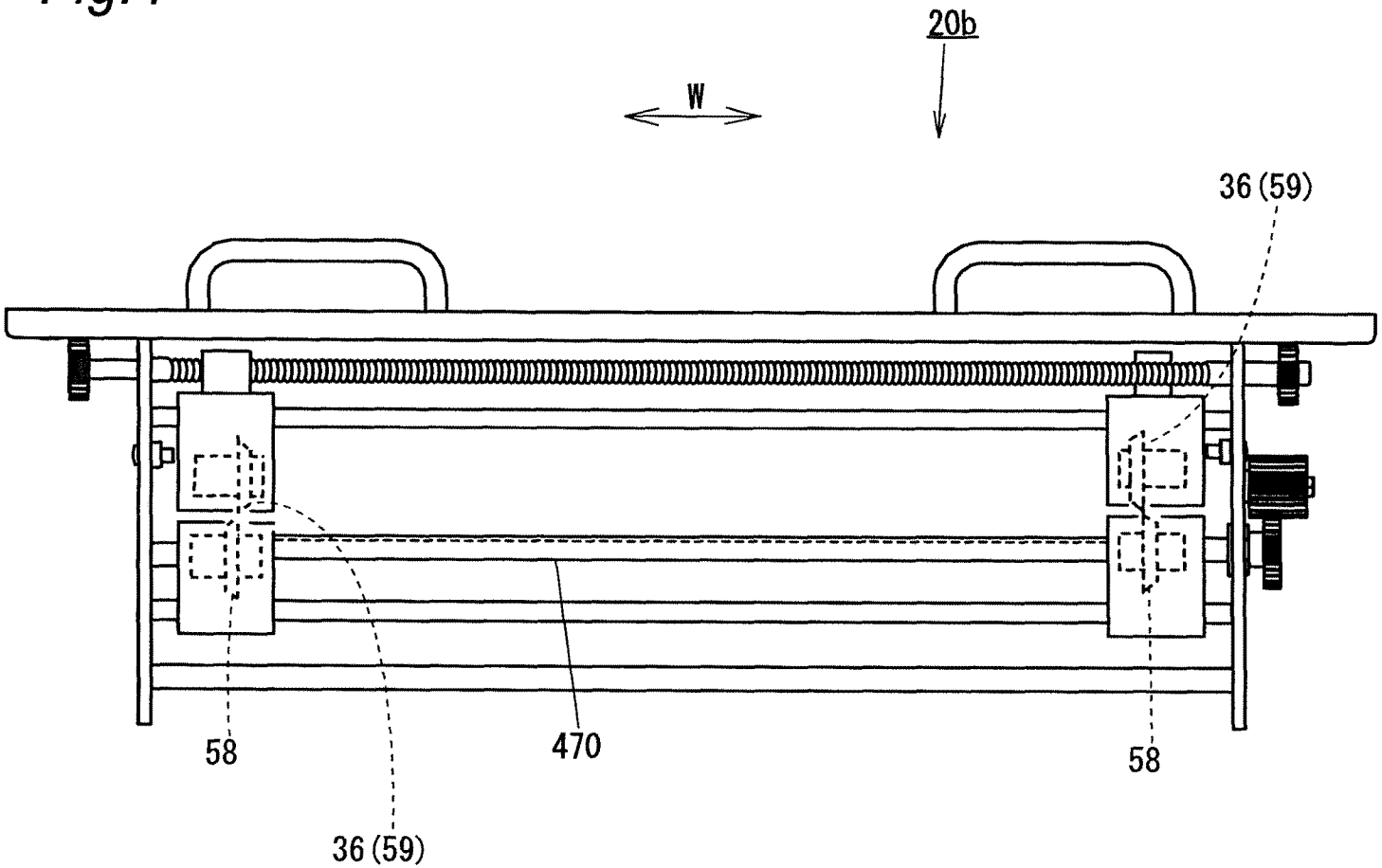
FIG. 4 is a view of a slitter processing part located in the center in the conveyance direction of the processing apparatus, viewed from upstream.

FIG. 4 is a view of the center unit 20*b* among the three units 20*a*, 20*b*, and 20*c* of the slitter processing parts 20, viewed from the upstream of the conveyance direction F of the sheet S. In the center unit 20*b*, the lower cutting blade 36*b* within a pair of the upper and the lower cutting blade 36 serves as the driver cutting blade 58 and the upper cutting blade 36 serves as the follower cutting blade 57. Then, the drive shaft 470 is located below the conveyance plane of the sheet S.

Then, similarly to the most upstream unit 20*a*, in the most downstream unit 20*c* among the three units 20*a*, 20*b*, and 20*c* of the slitter processing parts 20, the upper cutting blade 36*a* serves as the driver cutting blade 58 and the lower cutting blade 36 serves as the follower cutting blade 59. Then, the drive shaft 460 is located above the conveyance plane of the sheet S.

[Scrap Dropping Mechanism 27]

When the sheet S is cut along the conveyance direction F of the conveyance part 4 in the unit 20*b* located in the center in the conveyance direction F and in the most downstream unit 20*c* among the three units of the slitter processing parts 20 so that an unnecessary scrap Jb is generated in a middle of the sheet S having been cut off along the conveyance direction F, the scrap dropping mechanism 27 excludes the scrap Jb to the downward of the conveyance path 5. For example, the scrap dropping mechanism 27 may be constructed such as to move in association with the movement of the cutting blades 36 of the most downstream unit 20*c* in the width direction W. Then, when the sheet S passes through the scrap dropping mechanism 27, the scrap dropping mechanism 27 guides and drops the scrap Jb into the scrap collecting part 23.

[Crease Processing Part 21]

The crease processing part 21 includes: a lower die 39 having an upper recess; and an upper die 38 having a lower protrusion fit into the recess. Then, the upper die 38 is linked through a power transmission mechanism to a folding die drive part 49 constructed from a motor or the like. That is, when the upper die 38 is lowered by a driving force of the folding die drive part 49 so that a fold line in the width direction W perpendicular to the conveyance direction F is formed in the sheet S.

[Cutter Processing Part 22]

The cutter processing part 22 includes a pair of cutting blades 69 extending in the width direction W and arranged opposite to each other. One cutting blade 69 is constructed from an upper movable blade 71 and the other cutting blade 69 is constructed from a lower stationary blade 73. Then, the upper movable blade 71 goes into contact with or departs from the lower stationary blade 73 so as to cut the sheet S in the width direction W perpendicular to the conveyance direction F. The upper movable blade 71 is linked through a power transmission mechanism to a cutting drive part 50 constructed from a motor or the like.

Figure 5:
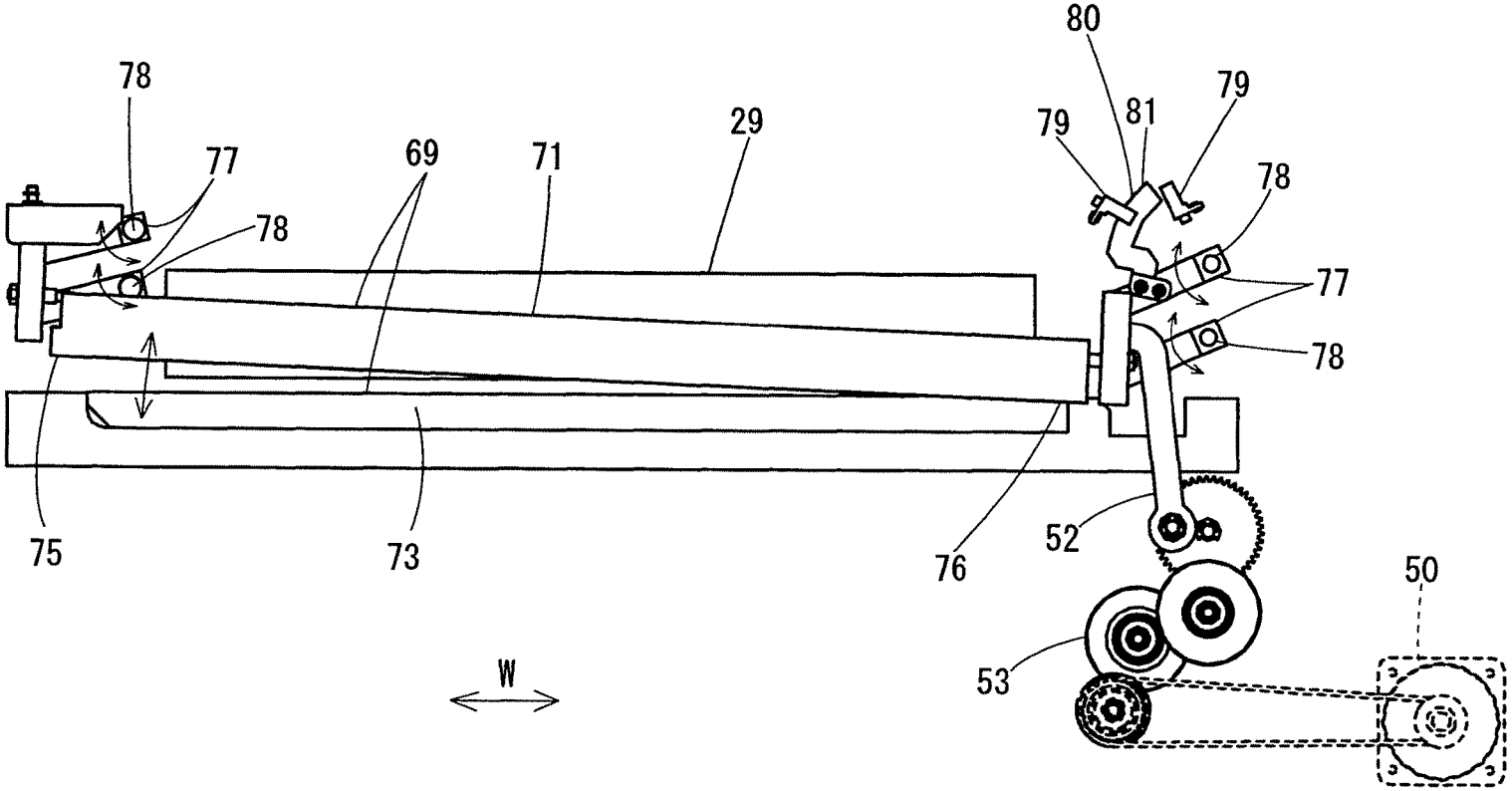
FIG. 5 is a view of a cutter processing part of the processing apparatus, viewed from upstream.

FIG. 5 shows a specific example of the cutter processing part 22. Here, in FIG. 5, a frame thereof is not shown. The lower stationary blade 73 is arranged substantially in a horizontal orientation such as to extend in the sheet width direction W. The upper movable blade 71 is tilted with reference to a horizontal direction such as to become lower as going from a blade tip part 75 to a blade pedestal part 76. Then, the upper movable blade 71 moves in the upper and lower directions together with an upper guide member 29 arranged in the upstream of the conveyance direction F. The upper guide member 29 avoids a situation that a cut-off piece J not nipped by the conveyance roller pair 17 in the upstream of the conveyance direction F relative to the cutting position leaps up in association with cutting.

The blade pedestal part 76 of the upper movable blade 71 is linked through a crank mechanism 52 and a power transmission mechanism 53 to the cutting drive part (a drive motor) 50 installed on the apparatus body 1 side. Then, by virtue of the driving power of the cutting drive part 50, with maintaining the tilted state, the upper movable blade 71 swings in the upper and lower directions about swing centers 78 of parallel linkage mechanisms 77 a pair of which is provided on each of both sides in the width direction W. By virtue of this, the upper movable blade 71 goes into contact with the lower stationary blade 73 successively from the blade pedestal part 76 side to the blade tip part 75 side in the width direction W so that the sheet S is cut. The position of the upper movable blade 71 is detected by a cutting blade position sensor 81 constructed from two photo sensors 79 and a light shield plate 80, and then transmitted to the control part 45. The cutting speed corresponding to the speed of successive contact of the upper movable blade 71 with the lower stationary blade 73 can be changed when the control part 45 controls the cutting drive part 50.

[Stacker Part 2]

The stacker part 2 accumulates the processing articles Q obtained by the processing of the processing part 24. The stacker part 2 includes a placement part 83 constructed such that the processing articles Q can be sorted and placed at different positions on the placement surface. The placement part 83 includes a belt conveyor 86 constructed such that the processing articles Q are carried on a belt 85 running in a circulated manner. The processing articles Q ejected by the conveyance part 4 are conveyed and placed on the belt conveyor 86.

The belt conveyor 86 constitutes a carrying member in which the processing articles Q are carried on the belt 85. The belt conveyor 86 serving as the carrying member is installed near an ejection port for the processing articles Q in the apparatus body 1. The carrying member includes a storage part (not shown) and then the type of the carrying member is stored in the storage part. Employable types of the carrying members in addition to the belt conveyor include: a sorting accommodation part in which the processing articles Q of predetermined size such as name cards, point cards, note cards, and postcards are sorted and accommodated into a box-shaped accommodation part; a lift table capable of vertical movement by using an elevator means; and a fixed type tilting table whose placement surface for the processing articles Q is tilted but not capable of elevating. The carrying member performs communication with the control part 45 by wire or wireless so that the control part 45 can identify the type of the carrying member.

The belt conveyor 86 includes an endless belt 85, conveyor rollers 87, and a conveyor driving part 40. The conveyor rollers 87 are installed and separated from each other by a predetermined amount in the ejection direction of the processing articles Q which is identical to the conveyance direction F of the sheet S. Then, the belt 85 is wound around the conveyor rollers 87. The length of the belt 85 in the width direction W is substantially the same as the width direction W length of the conveyance path 5 along which the sheet S is conveyed or, alternatively, is set to be a predetermined length somewhat longer than the conveyance path 5. Thus, a plurality of the processing articles Q ejected in parallel to each other in the width direction W can be placed on the belt 85. The conveyor driving part 40 is electrically connected to the control part 45 and then the control part 45 controls the driving amount of the conveyor driving part 40 so that the belt conveyor 86 is adjusted such as to run at a predetermined speed.

The stacker part 2 further includes a fullness detecting part 30 for sensing the fullness of the processing articles Q. The fullness detecting part 30 is constructed from an optical sensor or the like and thereby detects a situation that the processing articles Q on the placement part 83 exceeds a maximum allowable carrying amount.

[Scrap Collecting Part 23]

The scrap collecting part 23 includes a scrap accommodation box 54 and guides 59 and 60. The scrap accommodation box 54 is formed in a rectangular parallelepiped shape having an upper opening. The scrap accommodation box 54 collects and accommodates unnecessary scraps J having been cut off by the cutting part 19. The guides 59 and 60 guide to the scrap accommodation box 54 the scraps J having been cut off and dropped in the cutting part 19.

[Control Part 45]

The control part 45 controls the operation of the entire processing apparatus D. Then, the control part 45 acquires the information from the detection parts 31 to 35 and then, on the basis of the processing information for the sheets S having been set up through the operation panel 46 or the read unit 26, controls the driving of the supply unit 3, the conveyance part 4, the stacker part 2, and the individual processing parts 24 so as to perform the processing on the sheets S.

The control part 45 controls the stacker part 2 such as to sort a predetermined amount of precedently ejected ones of the processing articles Q from the subsequent ones of the processing articles Q among the processing articles Q ejected to the stacker part 2 by the conveyance part 4. Further, the control part 45 controls the stacker part 2 such as to perform the sorting processing on the processing articles Q in accordance with the number of ejected sheets of the processing articles Q ejected to the stacker part 2.

The control part 45, at the time of the sorting processing on the processing articles Q, controls the conveyance part 4 such as to stop the ejection operation for the processing articles Q to the stacker part 2. The control part 45 stores, into a storage device, information concerning the sorting processing on the processing articles Q performed in the stacker part 2. The control part 45, at the time of the sorting processing on the processing articles Q, controls a drive part of the belt conveyor 86 such as to change a running speed of the belt conveyor 86. The control part 45, when a predetermined time has elapsed since the time point of the sorting processing on the processing articles Q, controls the conveyance part 4 such as to automatically resume the ejection operation for the subsequent ones of the processing articles Q to the stacker part 2. The control part 45, when a predetermined time has elapsed since the time point of the sorting processing on the processing articles Q, controls the conveyance part 4 and the processing part such as to terminate the processing on the sheets S. The control part 45 identifies the type of the carrying member installed in the stacker part 2 and then controls the individual parts on the basis of the identification result. The control part 45, on the basis of the information imparted to the sheet S concerning the sorting processing on the processing articles Q in the stacker part 2, controls the individual parts. The control part 45, on the basis of the sorting information concerning whether the sorting processing on the processing articles Q in the stacker part 2 is to be executed, judges whether the sorting processing on the processing articles Q is to be executed.

The control part 45 controls the processing part such that in a case that the processing position of the processing member is different for the precedent ones and for the subsequent ones of the processing articles Q to be processed in the sorting processing, the processing member located at a precedent processing position serving as the processing position for the processing articles Q to be precedently ejected to the stacker part 2 may be moved to a reference position and then moved from the reference position to a subsequent processing position serving as the processing position for the subsequent ones of the processing articles or, alternatively, may be moved from the precedent processing position to the subsequent processing position and then the processing may be executed and such that in a case that the processing position of the processing member is identical for the precedent ones and for the subsequent ones of the processing articles Q to be processed in the sorting processing, the subsequent processing may be started without moving the processing member located at the precedent processing position.

The control part 45 controls the processing part such that in a case that the processing position is different for the precedent ones and for the subsequent ones of the processing articles Q to be processed in the sorting processing, the supply tray 61 for supplying the sheets S to the conveyance path 5 may be moved to a waiting position from a supplying position where the sheets S can be supplied to the conveyance path 5 and such that in a case that the processing position is identical for the precedent ones and for the subsequent ones of the processing articles Q to be processed in the sorting processing, the processing on the sheets S may be started in a state that the supply tray 61 is maintained at the supplying position.

[Processing Pattern of Sheet]

FIG. 6 is a plan view showing an example of a processing pattern of the sheet S. In the processing pattern shown in the figure, a plurality of processing articles Q are to be fabricated from one sheet S. Set up in the pattern are: cutting lines T serving as a plurality of processing lines extending in parallel to the conveyance direction F; and cutting lines K serving as a plurality of processing lines extending in the width direction W perpendicular to the conveyance direction F.

The first and the sixth cutting line T1 and T6 shown at the right end and the left end in FIG. 6 are formed by the unit 20*a* installed in the most upstream among the slitter processing parts 20 in the conveyance path 5 in FIG. 1. The second and the fifth cutting line T2 and T5 faulted inside between the first cutting line T1 and the sixth cutting line T6 are formed by the unit 20*b* located in the center in the conveyance direction F. The third and the fourth cutting line T3 and T4 formed more inside between the second cutting line T2 and the fifth cutting line T5 are formed by the unit 20*c* installed in the most downstream in the conveyance direction F. Strip-shaped unnecessary scraps Jb generated between the second cutting line T2 and the third cutting lines T3 and between the fourth cutting line T4 and the fifth cutting lines T5 are guided downward by the scrap dropping mechanism 27 shown in FIG. 1 and then collected by the scrap collecting part 23.

Further, in a situation that the sheet S is cut along the cutting lines T1 to T6 in parallel to the conveyance direction F and then the long scraps J cut out from the sheet S are removed so that a plurality of strip-shaped cut pieces aligned in the width direction W are obtained, the cutting lines K are formed by performing a plurality of cutting processing simultaneously on the plurality of strip-shaped cut pieces.

Here, in the processing pattern of the sheet S shown in FIG. 6, a fold line formed by the crease processing part 21 is not set up. Thus, in the processing parts 24 illustrated in FIG. 1, the crease processing part 21 may be installed in the receiving part 6 and maintained in a non-operating state such that the crease processing may be not performed or, alternatively, may be replaced with a conveyance processing part (not shown). Alternatively, the crease processing part 21 may be removed from the receiving part 6 and then the processing is performed in a state that the receiving part 6 is vacant.

Various processing information to be applied to the sheet S concerning such arrangement pattern of the processing articles Q is set up by the user through the operation panel 46 or, alternatively, recorded in the bar code M2 of the sheet S. The various processing information includes: information concerning the sheet S itself like the predetermined directional lengths such as the conveyance directional length and the width directional length, the thickness, the type of the sheet S; information concerning the processing articles Q like the arrangement, the number, and the dimensions of the processing articles Q; and information concerning the processing on the sheets S like the size and the number of each unnecessary scrap J to be cut out from the sheet S and like information concerning the sorting processing on the processing articles Q. The information concerning the sorting processing includes: sorting necessity or non-necessity information concerning whether the sorting processing in the stacker part 2 is to be executed; sorting timing information concerning the timing when the sorting processing is to be executed; the sorting distance information concerning the distance between the precedent one and the subsequent one of the processing articles Q sorted in the placement part 83; sorting carry information concerning the carrying method for the sorted processing articles Q like the overlap length between the precedent processing article Q and the subsequent processing article Q; and sorting notice information concerning whether a notice by light or sound is to be generated at the time of sorting.

The processing information whose setting has been completed once can be stored in the storage device of the control part 45. Each of a plurality of different processing information pieces like arrangement patterns for the processing articles Q in the sheet S is stored into the storage device in a state that a number, a processing name, a name, or the like is imparted. By virtue of this, the user operates the operation panel 46 serving as the operation part so as to read from the storage device the processing information concerning the required processing contents so that the sheet S can be processed.

[Operation of Processing Apparatus]

The operation of the processing apparatus D of the present embodiment is described below. First, description is given for a series of operation at the time that a predetermined number of the sheets S are to be processed with the processing pattern shown in FIG. 6. At the time of using the processing apparatus D, the user inputs the various processing information through the operation panel 46 shown in FIG. 1. When the same processing as the processing contents already registered and stored in the storage device is to be executed, the user operates the operation panel 46 serving as the operation part so as to input the number, the processing name, the name, or the like and thereby read out the required processing information from the storage device. Then, the user inputs the processing number of sheets for the sheets S through the operation panel 46 and then performs the operation of processing start.

Figure 7:
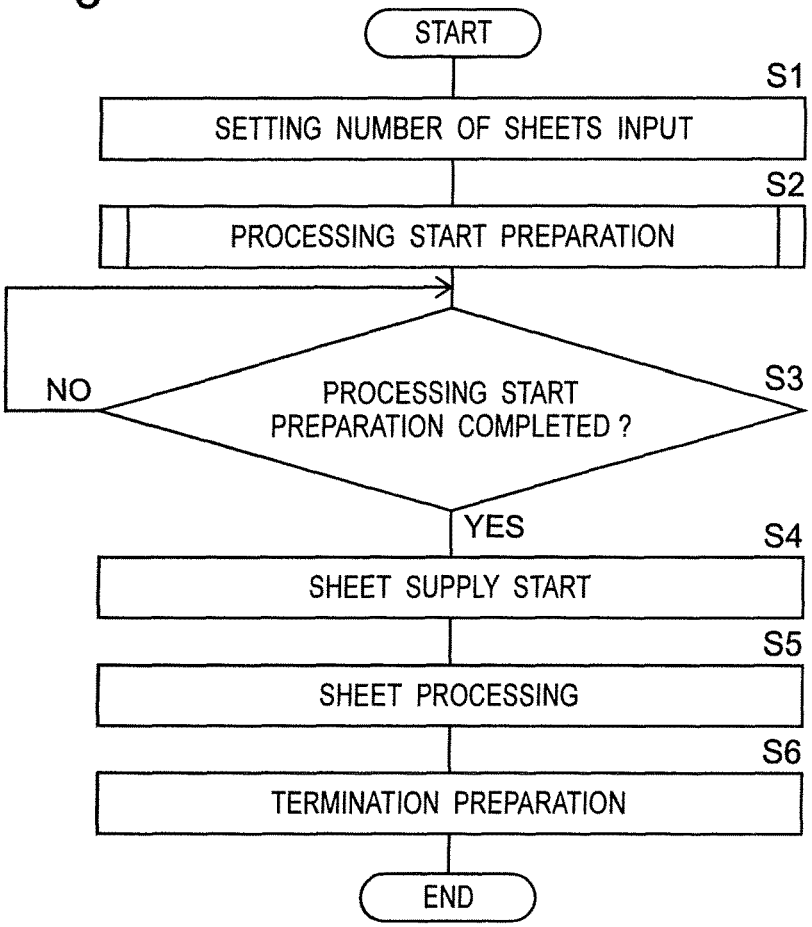
FIG. 7 is a flow chart of processing performed on sheets by the processing apparatus.
Figure 8:
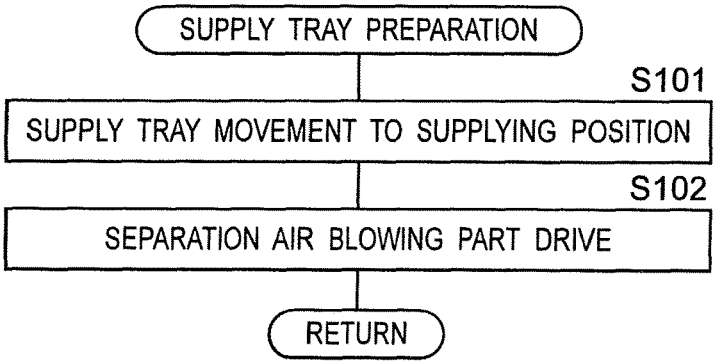
FIG. 8 is a flow chart of processing performed on sheets by the processing apparatus.
Figure 9:
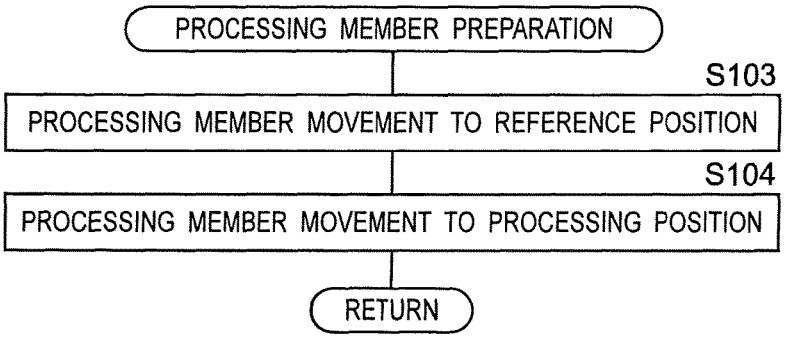
FIG. 9 is a flow chart of processing performed on sheets by the processing apparatus.

FIG. 7 is a flow chart of performing the processing on the sheet S with the pattern shown in FIG. 6. At Step 1 in FIG. 7, a setting number of sheets S on which the processing is to be performed is inputted by the user. Then, when the operation of processing start is performed by the user, the control part 45 at Step 2 performs preparation for the processing start. In the preparation for the processing start at Step 2, a plurality of operation procedures are executed in parallel to each other. FIG. 8 shows a flow concerning the preparation of the supply tray 61 among the preparation operation procedures for the processing start at Step 2. FIG. 9 shows a flow concerning the preparation of the processing members within Step 2. At Step 101 in FIG. 8, the control part 45 drives and controls the elevating means in order to raise the supply tray 61, and then moves the supply tray 61 to the supplying position where the sheets S on the supply tray 61 can be supplied to the conveyance path 5.

Then, at Step 102 in FIG. 8, the control part 45 drives the separation air blowing part 63. The separation air blowing part 63 supplies air blow toward the front edges Sf of the plurality of sheets S on the supply tray 61 so that the sheets S are separated from each other.

Further, at Step 103 in FIG. 9, the control part 45 moves each cutting blade 36 serving as the processing member to the reference position. At the time that the processing start for the sheet S has been performed, each cutting blade 36 is located at the processing position in the processing pattern of the processing articles Q precedently ejected to the stacker part 2. This cutting blade 36 is to be moved from the processing position to the reference position. The reference position is set up as a home position outside the conveyance path 5 in the width direction W. Thus, the control part 45 drives the processing member movement drive part so as to revolve the threaded shaft 511 through the gear 514 by a predetermined amount required for the movement from the processing position to the reference position of each cutting blade 36. The upper and the lower holder 365 and 366 for holding the cutting blades 36 are moved by a predetermined amount in the width direction W in association with the revolution of the threaded shaft 511.

At Step 104, the control part 45 is to move each cutting blade 36 serving as the processing member from the reference position to the processing position for the subsequent processing articles Q. For this purpose, the control part 45 controls the processing member movement drive part so as to revolve the threaded shaft 511 by a predetermined amount and thereby move to a predetermined cutting position the upper and the lower holders 365 and 366 holding the cutting blades 36 so that each cutting line T is formed that serves as the processing line along the conveyance direction F in the processing pattern shown in FIG. 6.

At Step 3 in FIG. 7, the control part 45 checks whether the preparation for the processing start has been completed. The control part 45 repeats Step 3 until the supply tray 61 has moved to the supplying position and all processing members have completed the movement to the processing positions. When all cutting blades 36 have completed the movement, the cutting blades 36 are being ready for cutting. When the preparation for the processing start has been completed, Step 3 is satisfied and hence the procedure goes to Step 4.

At Step 4, the control part 45 starts the supply operation for the sheets S to the conveyance path 5. At that time, the control part 45 drives the suction fan 67 so as to cause the uppermost sheet S alone to be suctioned. After that, the control part 45 causes the belt rollers 65 and the feed rollers 8 to revolve. Thus, the conveyance belt 64 runs in association with the revolution of the belt rollers 65 and then the uppermost sheet S is suctioned by the suction fan 67 and then supplied to the conveyance path 5. After the feed rollers 8 have nipped the sheet S, the sheet S is conveyed and supplied to the conveyance path 5 by the feed rollers 8 and the suction conveyance part 62.

At Step 5, the control part 6 performs the processing on the set-up predetermined number of sheets S. At that time, the control part 45 drives the conveyance drive parts 41 to 44 and the revolution drive part 48 in the same timing as the supply operation start for the sheets S. As a result of the driving by the conveyance drive parts 41 to 44, all conveyance rollers 9 to 17 revolve in synchronization with each other. Further, as a result of the driving of the revolution drive part 48, the drive shafts 460 and 470 are revolved through the power transmission mechanism 393 and hence the driver cutting blades 58 of all cutting blades 36 are simultaneously revolved. As a result of the revolution of the driver cutting blades 58, the follower cutting blades 59 brought into pressure contact with the driver cutting blades 58 by the biasing parts 397 follow and revolve.

The control part 45 can control the supply unit 3 such that the timing of supplying the sheet S from the supply unit 3 to the conveyance path 5 is set such that after the entire processing on the first sheet S performed by the processing parts 24 has been completed and then all the obtained processing articles Q have completely been ejected to the stacker part 2, the next sheet S may be supplied. In this case, one sheet S alone at a time is present in the inside of the apparatus body 1 so that the processing can stably be performed. Further, in place of the above-mentioned setting, the control part 45 may control the supply unit 3 such that in a situation that the precedent sheet S located in the inside of the apparatus body 1 is under conveyance and under processing, the subsequent sheet S is supplied to the conveyance path 5. In this case, a plurality of the sheets S are present in the inside of the apparatus body 1. As such, in a case that the subsequent sheet S is supplied to the conveyance path 5 before the processing on the precedent sheet S is completed so that a plurality of the sheets S are successively conveyed and the processing is successively performed, the processing time can be reduced.

The sheet S supplied onto the conveyance path 5 is conveyed toward the downstream to the read unit 26 by the conveyance part 4. The read unit 26 reads the position mark M1 (and also the bar code M2, when necessary) of the sheet S so that various processing information to be applied to the sheet S is acquired.

The rejection mechanism 25 operates in an abnormal case that the position mark M1 cannot appropriately be read by the read unit 26 or that the processing information is not set up nor read out and further the bar code M2 cannot be read so that the processing conditions are unknown. Then, the rejection mechanism 25 drops and collects such an unrecognizable sheet S into the tray 25*a*.

In each slitter processing part 20, the sheet S passes through the pressure contact part 29 where the driver cutting blade 58 and the follower cutting blade 59 under revolution are in pressure contact with each other and lapped together. In the most upstream unit 20*a*, the first and the sixth cutting line T1 and T6 shown at the right end and the left end in FIG. 6 are formed. The scraps Ja at both right and left edges having been cut off by the cutting blades 36 are guided downward by the margin dropping member 55 and then guided and accommodated into the scrap accommodation box 54 by the guide 59.

In the unit 20*b* in the center of the conveyance direction F, the second and the fifth cutting line T2 and T5 are formed.

In the unit 20*c* installed in the most downstream in the conveyance direction F, the third and the fourth cutting line T3 and T4 are formed. The strip-shaped scraps Jb generated between the second cutting line T2 and the third cutting lines T3 and between the fourth cutting line T4 and the fifth cutting lines T5 are guided downward by the scrap dropping mechanism 27 shown in FIG. 1 and then accommodated into the scrap accommodation box 54.

As such, when the sheet S is cut in the cutting processing by the cutting blades 36 and then the processing articles Q and the scraps J are separated from each other, the lower cutting blades 36*b* are located on the same side as the processing article Q relative to the cutting lines T in the width direction W and the upper cutting blades 36*a* are located on the same side as the scrap J. In the width direction W, since the lower cutting blades 36*b* are located on the same side as the processing article Q, the processing article Q obtained by forming of the cutting lines T and then being separated can be supported from below by the lower cutting blades 36*b* and hence can appropriately be conveyed to the downstream. On the other hand, in the width direction W, since the upper cutting blades 36*a* are located on the same side as the scrap J, the scrap J separated from the sheet S can be guided downward by the upper cutting blades 36*a*.

As for the combination of a pair of the right and the left cutting blades 361 to 366 in the units 20*a* to 20*c* in the slitter processing parts 20, it is preferable that a combination is not employed that both upper cutting blades 36*a* are located outside the lower cutting blades 36*b* relative to the generated scrap J. Then, it is preferable that with reference to each cutting line T separating the processing article Q from the scrap J, at least any one of the upper cutting blades 36*a* is located on the side where the scrap J is generated and that the lower cutting blade 36*b* is located on the side where the processing article Q is generated.

Figure 10A:
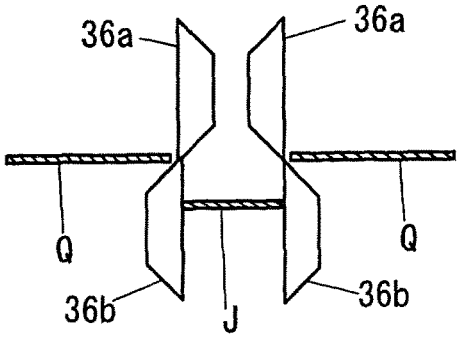
FIG. 10A is diagram describing a usage mode of the processing apparatus.
Figure 10B:
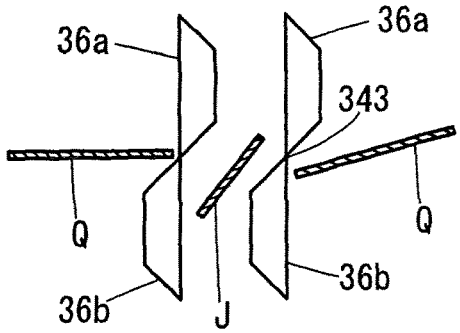
FIG. 10B is diagram describing a usage mode of the processing apparatus.
Figure 10C:
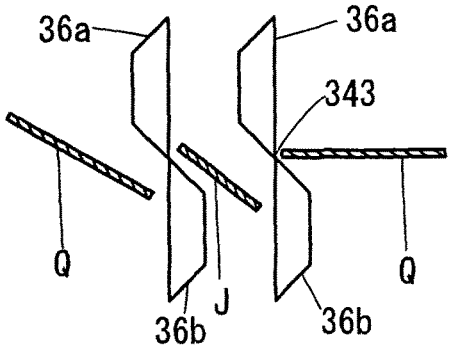
FIG. 10C is diagram describing a usage mode of the processing apparatus.
Figure 10D:
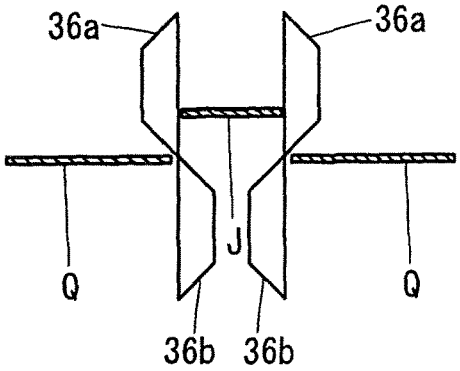
FIG. 10D is diagram describing a usage mode of the processing apparatus.

Specifically, a combination shown in FIG. 10D is to be avoided that both the right and the left upper cutting blade 36*a* with the generated scrap J in between are located on the side of generation of the processing article Q with reference to each cutting line. Allowable combinations are shown in FIGS. 10A, 10B, and 10C. FIG. 10A shows a combination that the upper cutting blades 36*a* are located on the inner side of the lower cutting blades 36*b* relative to the generated scrap J. FIG. 10B or 10C shows a combination that any one of the upper cutting blades 36*a* is located on the inner side of the lower cutting blade 36*b* relative to the generated scrap J and that the other upper cutting blade 36*a* is located outside the lower cutting blade 36*b* relative to the generated scrap J.

A configuration that the upper cutting blade 36*a* is installed on the right side of the pressure contact part 343 of the upper and the lower cutting blade 36*a* and 36*b* as shown in FIG. 10B is employed in the cutting blade 361 on the right side of the most upstream unit 20*a*, the cutting blade 364 on the left side of the center unit 20*b*, and the cutting blade 365 on the right side of the most downstream unit 20*c*. A configuration that the upper cutting blade 36*a* is installed on the left side of the pressure contact part 343 of the upper and the lower cutting blade 36*a* and 36*b* as shown in FIG. 10C is employed in the cutting blade 362 on the left side of the most upstream unit 20*a*, the cutting blade 363 on the right side of the center unit 20*b*, and the cutting blade 366 on the left side of the most downstream unit 20*c*.

Figure 11:
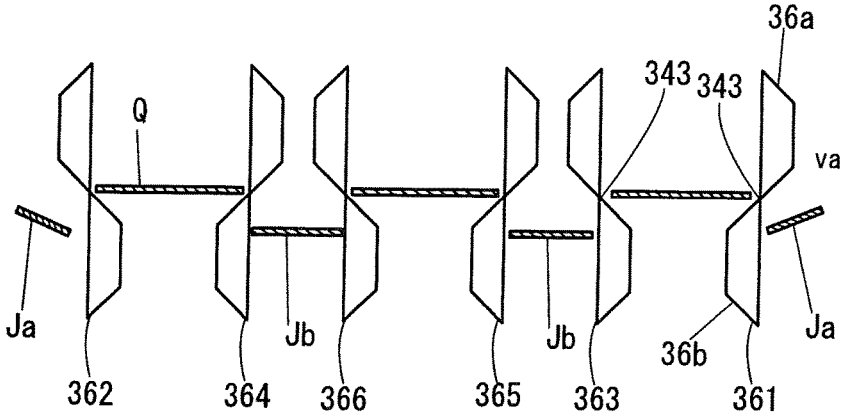
FIG. 11 is a diagram describing a usage mode of the processing apparatus.

The most upstream unit 20*a* forms the cutting lines T1 and T6 on the outermost side of the sheet S. Further, the center unit 20*b* forms the cutting lines T2 and T5 on the inner side of the cutting lines T1 and T6. Further, the most downstream unit 20*c* forms the cutting lines T3 and T4 on the most center side of the sheet S. By virtue of this, as shown in FIG. 11, all upper cutting blades 36*a* are each located on the side where the scrap Ja or Jb is generated relative to the pressure contact part 343 for forming the cutting line T and all the lower cutting blades 36*b* are each located on the side where the processing article Q is generated relative to to the pressure contact part 343. Thus, the scrap J can appropriately be dropped and further the sheet S in which the processing has been performed in part can appropriately be conveyed to the downstream.

In the scrap dropping mechanism 27, the scraps Jb cut out from the sheet S by the center unit 20*b* and the most downstream unit 20*c* among the slitter processing parts 20 are moved downward to the scrap collecting part 23 located below and then accommodated into the scrap accommodation box 54.

In the cutter processing part 22, at a timing that each cutting line K of the sheet S arrives at the cutting blade 36 installation position, the supply unit 3, the conveyance part 4, and the revolution drive part 48 are stopped so that conveyance of the sheet S is stopped. The control part 45 drives the cutting drive part 50 such that the upper movable blade 71 may approach the lower stationary blade 73 so that the sheet S is cut along the width direction W. In association with the driving by the cutting drive part 50 after the cutting, the upper movable blade 71 goes up and separates from the lower stationary blade 73. Then, the scrap Jc cut out from the sheet S in the cutting processing moves downward and is then guided by the guide 60 so as to be collected by the scrap collecting part 23.

The processing articles Q having been cut out and obtained by the cutter processing part 22 are ejected to the stacker part 2. The control part 45 drives the conveyor driving part 40 so as to revolve the conveyor rollers 87 and thereby cause the belt 85 to run in a circulated manner at a predetermined speed. When the belt 85 is caused to run at a fixed speed slower than the ejection speed of the processing articles Q, the processing articles Q ejected with time intervals one by one from the conveyance path 5 can be stacked together on the placement surface in a slightly deviated manner from each other like sliced raw fish pieces.

Further, in place of a configuration that the belt 85 is caused to run at a fixed speed, the control part 45 may drive and control the conveyor driving part 40 such that the belt 85 performs intermittent running. That is, in the control part 45, the conveyor driving part 40 is not driven until the processing article Q has been ejected and then the belt 85 is caused to run by a predetermined amount after the ejection of the processing article Q has been completed. After that, the conveyor driving part 40 is stopped. When these operation procedures are repeated, the processing articles Q can be placed with equal deviation intervals regardless of the ejection speed or timing for the processing articles Q by the conveyance part 4. Thus, the user can align with satisfactory performance the processing articles Q placed on the placement part 83 so that the working efficiency can be improved.

At Step 5 in FIG. 7, when the processing on the setting number of sheets S has been completed, the procedure goes to Step 6 and hence the control part 6 performs preparation for terminating the processing on the sheets S. Specifically, the control part 45 drives and controls the elevating means so as to move the supply tray 61 from the supplying position to the waiting position. Then, the driving is stopped in the suction fan 67, the separation air blowing part 63, the conveyance drive parts 41 to 44, and the revolution drive part 48. Here, in the termination preparation processing at Step 6, the control part 45 does not drive the processing member movement drive part, that is, does not cause each cutting blade 36 serving as the processing member to move to the reference position. Thus, the cutting blade 36 is located intact at the processing position.

At this point, a series of the processing on the sheets S is completed. After that, in a case that the processing pattern of the processing to be executed next is the same as the last processing having been completed at present, the user inputs the processing number of sheets alone through the operation panel 46 and then performs the operation of processing start intact without changing the already inputted processing information, so that the next processing can be started. In a case that the processing number of sheets of the processing to be executed is the same as the last processing, the user executes the operation of processing start alone intact without changing the processing number of sheets and the processing information having already been inputted, so that the next processing can be started.

For example, it is assumed that the processing article Q shown in FIG. 6 is a name card and that the person name, the company name, the address, the telephone number, and the like are printed on the surface (and also the back face, when necessary) of the processing article Q. Then, in a case that 100 sheets of person A's name cards are to be fabricated and then 200 sheets of person B's name cards are to be fabricated, the user of the processing apparatus D places, on the supply tray 61, five sheets S on which the name, the company name, and the like of the person A are printed and ten sheets Son which the name, the company name, and the like of the person B are printed. At that time, on the supply tray 61, the sheets S for the person A's name cards are to be located on top of the sheets S for the person B's name cards. Here, in the processing pattern shown in FIG. 6, 21 sheets of processing articles Q are obtained per one sheet S. Thus, 105 name cards can be obtained from the five sheets S and 210 name cards can be obtained from the ten sheets S. However, 100 sheets of person A's name cards are sufficient and hence five name cards are obtained as spare cards. Further, ten spare cards are obtained in the person B's name cards.

The user inputs through the operation panel 46 the processing information concerning the processing pattern shown in FIG. 6 or, alternatively, reads out the processing information from the storage device. Then, a value of 5 serving as the processing number of sheets for the sheets S for the person A's name cards is inputted as the setting number of sheets, and then the operation of processing start is performed. Then, the processing apparatus D performs the processing on the sheets S in accordance with the flow shown in FIGS. 7 to 9 so that 105 sheets of person A's name cards are fabricated.

Then, the user changes the setting number of sheets S into 10 by using the operation panel 46. The processing information is not changed and remains intact and the same as the last processing information. At that time, in a case that the processing on the sheets S are performed in accordance with the flow shown in FIGS. 7 to 9, a predetermined time are taken in: the movement of the supply tray 61 from the waiting position to the supplying position at Step 101; the movement of the processing member from the processing position to the reference position at Step 103; the movement of the processing member from the reference position to the processing position at Step 104; and the checking of the processing start preparation completion at Step 3.

However, in the sheets S for the person A's name cards and for the person B's name cards to be processed precedently and subsequently, the type and the size of the sheet S are identical between these cases, further, the sheets S are placed on the supply tray 61 at the same time. Thus, at the time of processing start for the sheets S for the person B's name cards, the supply tray 61 need not be moved from the waiting position to the supplying position and hence the time taken for this is useless.

Thus, the processing apparatus D according to the present embodiment is constructed such that the processing apparatus D can go into a waiting mode before executing the termination preparation processing at Step 6 and such that in the waiting mode, in a case that the processing position for the processing articles Q to be processed is identical for the precedent ones and for the subsequent ones, supply tray maintaining setting can be selected in which the processing on the sheets S is started in a state that the supply tray 61 for supplying the sheets S to the conveyance path 5 is maintained at the supplying position.

Further, in the sheets S for the person A's name cards and for the person B's name cards to be processed precedently and subsequently, the cutting position in the width direction W by each cutting blade 36 is the same. Thus, after the completion of the processing on the sheets S for the person A's name cards, the cutting blade 36 need not perform reciprocating movement between the processing position and the reference position at the time of processing start for the sheets S for person B's name cards. That is, the time taken for the reciprocating movement is useless. In addition, in a case that the cutting blade 36 is moved despite that the precedent and subsequent processing positions are the same as each other, a risk of affecting the precision of the processing may be caused. In some cases depending on the processing conditions, the precision in the obtained processing articles is more satisfactory when the cutting blade 36 is not moved and is maintained at the same processing position.

Thus, the processing apparatus D according to the present embodiment is constructed such that in the waiting mode, the processing member maintaining setting can be selected in which in a case that the processing position of the cutting blade 36 serving as the processing member is identical for the precedent ones and for the subsequent ones of the processing articles Q to be processed, the subsequent processing can be started without moving to the reference position the processing member located at the precedent processing position serving as the processing position for the processing articles Q precedently ejected to the stacker part 2.

Further, in a case that each processing position for the processing articles Q is identical and the shape and the size of the processing articles Q are identical like in a case that the processing articles Q to be processed precedently and subsequently are both name cards, it is preferable that the processing articles Q ejected precedently and subsequently are sorted into the person A's name cards and the person B's name cards. Thus, the control part 45 is constructed such as to be capable of performing control in such a manner that when necessary, a predetermined amount of precedently ejected processing articles Q among the processing articles Q ejected to the stacker part 2 by the conveyance part 4 may be sorted from the subsequent processing articles Q. In particular, in case that the processing contents to be executed are identical for the precedent ones and for the subsequent ones, automatic sorting processing setting in which sorting processing is automatically performed can be selected in the waiting mode.

The operation panel 46 of the processing apparatus D performs display for selecting the waiting mode. When the waiting mode has been selected, the processing is executed and, after that, the termination preparation at Step 6 in FIG. 7 is not executed so that a waiting operation state is maintained for a predetermined time. The information concerning whether the waiting mode is to be executed can be related to the processing information and then stored into the storage device. Thus, when the user reads out the desired processing information from the storage device, the waiting mode can automatically be activated. Further, in addition to the operation of the operation panel 46 and the read out of the storage device or, alternatively, in place of these, the information concerning whether the waiting mode is to be executed may be recorded in the bar code M2 of the sheet S.

Figure 12:
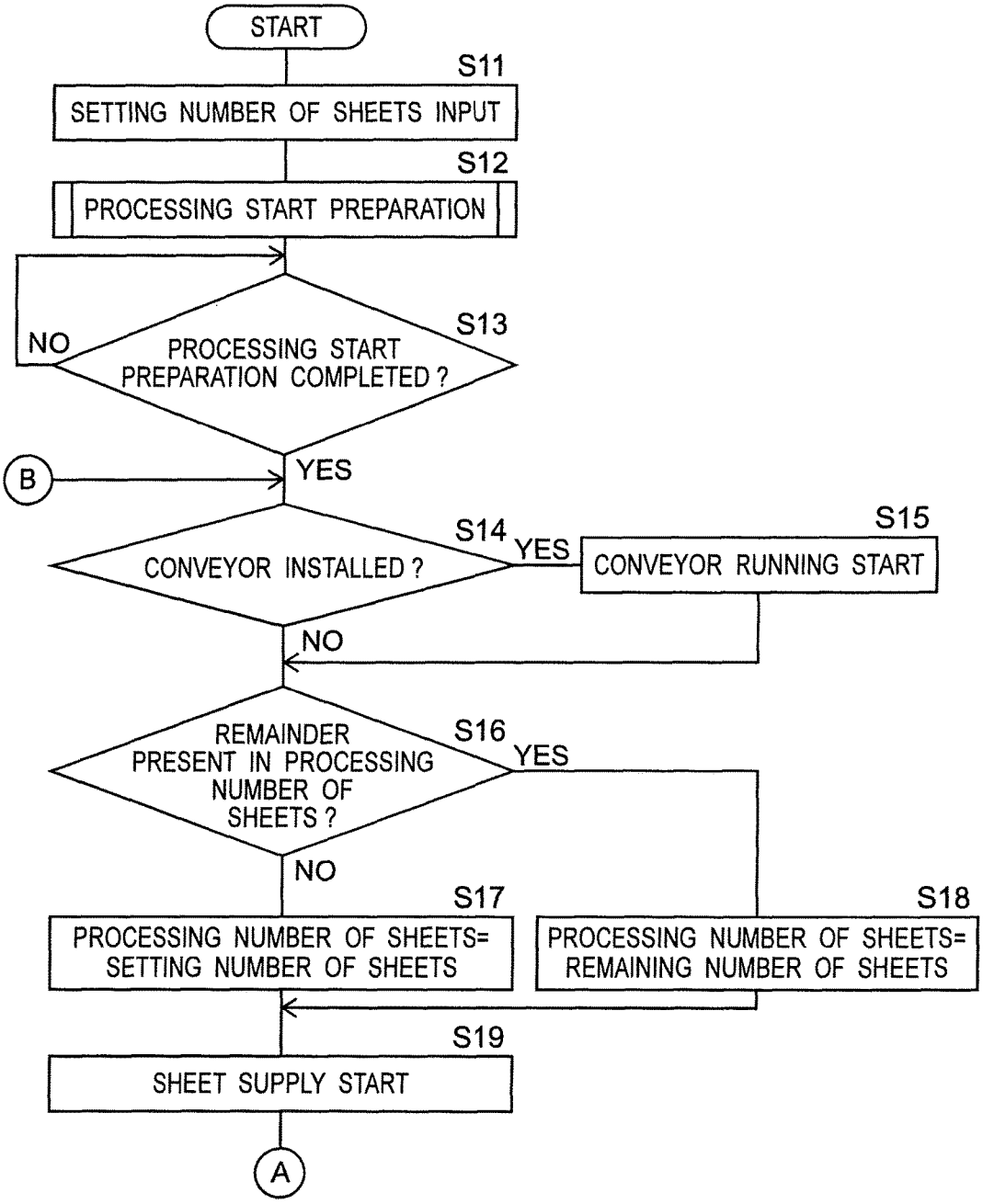
FIG. 12 is a flow chart of processing performed on sheets by the processing apparatus.
Figure 13:
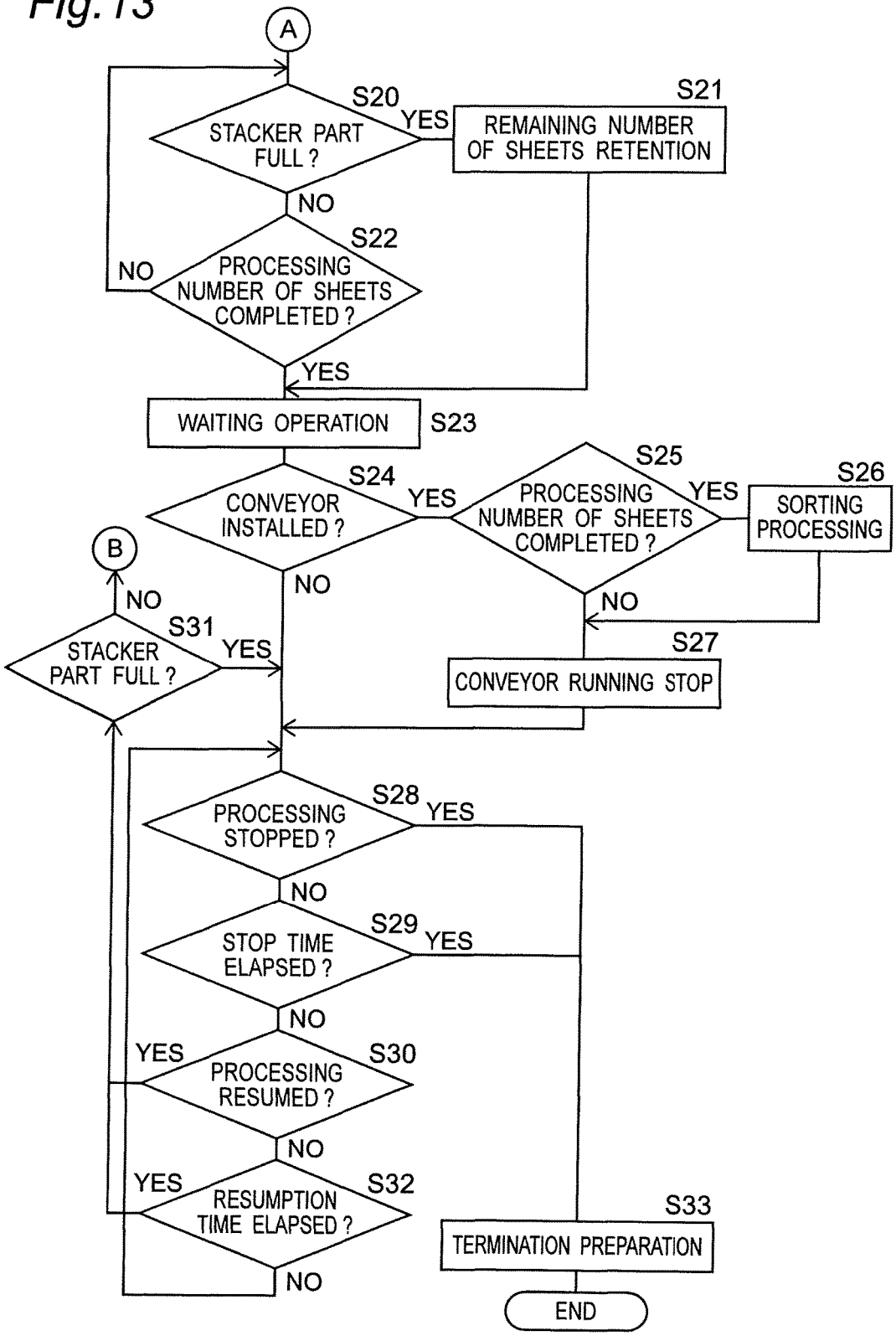
FIG. 13 is a flow chart of processing performed on sheets by the processing apparatus.

FIGS. 12 and 13 are flow charts in a case that the user has selected the waiting mode. Steps 11 to 13 in this figure are the same as Steps 1 to 3 in FIG. 7. At Step 14 in FIG. 12, the control part 45 identifies the type of the carrying member installed in the stacker part 2. For this purpose, the control part 45 performs communication with the storage part of the carrying member. As such, since the control part 45 identifies the type of the carrying member installed in the stacker part 2, the processing articles Q can appropriately be placed in accordance with the type of the carrying member installed in the stacker part 2.

When it is judged that the belt conveyor 86 is installed as the carrying member, the procedure goes to Step 15. Then, the control part 45 drives the conveyor driving part 40 so as to starts the running of the belt conveyor 86. The running speed of the belt conveyor 86 at Step 15 is a predetermined carrying speed. When the carrying speed is set slower than the speed at which the processing articles Q are ejected to the stacker part 2 by the conveyance part 4, the processing articles Q can be stacked together on the placement part 83 in a slightly deviated manner from each other. Further, when the carrying speed is set to be the same as or faster than the speed at which the processing articles Q are ejected to the stacker part 2 by the conveyance part 4, the processing articles Q can be placed on the placement part 83 sheet by sheet without overlapping with each other. Here, in a case that sorting processing is to be executed but the processing articles Q need not be stacked together in a slightly deviated manner from each other or placed sheet by sheet without overlapping with each other by any reason like a case that the number of sheets of the processing articles Q to be sorted and placed is small, the running of the belt conveyor 86 at the carrying speed at Step 15 may be not executed and hence the belt conveyor 86 may be maintained in a stopped state.

At Step 14, when it is judged that the belt conveyor 86 is not installed as the carrying member, the procedure goes to Step 16. Then, at Step 16, it is checked whether a remainder is present in the processing number of sheets. At a stage that the processing for the five sheets S for the person A's name cards has been completed and hence the processing on the sheets S for the person B's name cards is to be started, no remainder is present in the processing number of sheets and hence Step 16 is not satisfied. In this case, the procedure goes to Step 17. At Step 17, the processing number of sheets is set equal to the setting number of sheets inputted at Step 11. For example, at Step 11, in a case that a value of 10 serving as the number of sheets S for the person B's name cards is inputted as the setting number of sheets, the processing number of sheets at Step 17 becomes ten.

At Step 16, in a case that a part of the sheets S within the setting number of sheets inputted by the user have been processed and the remaining sheets S are not yet processed, Step 16 is satisfied and hence the procedure goes to Step 18 so that the processing number of sheets is set equal to the remaining number of sheets. Then, the procedure goes to Step 19 so that the supply of the sheet S to the conveyance path 5 is started and thereby the processing is executed on the sheets S of the number adopted as the processing number of sheets at Steps 17 and 18.

The procedure goes from Step 19 in FIG. 12 to Step 20 in FIG. 13 so that it is judged at Step 20 whether the stacker part 2 is full. At Step 20, when the fullness detecting part 30 has found the fullness of the placement part 83, the procedure goes to Step 21 so that the remaining number of sheets is retained and then the procedure goes to Step 23.

When the fullness detecting part 30 has found the fullness of the placement part 83, the situation that the stacker part 2 is full may be notified to the user. Employable notification method are not limited to a particular one. That is, various means may be employed like display onto the operation panel 46, warning by using a revolving warning light such as a patrol lamp, and notification to a portable terminal such as a smartphone.

At Step 20, when the stacker part 2 is not full, the procedure goes to Step 22. At Step 22, it is judged whether the processing on the amount adopted as the processing number of sheets has been completed. When Step 22 is not satisfied, the procedure returns to Step 20. Then, Steps 20 to 22 are repeated until the processing number of sheets is completed at Step 22. When the processing number of sheets have been completed, the procedure goes to Step 23.

At Step 23, the control part 45 controls the individual parts such as to perform waiting operation. In the waiting operation, the suction fan 67 is stopped and the driving of the drive part 47 for supply and the conveyance drive parts 41 to 44 is stopped. By virtue of this, the conveyance operation for the sheets S is stopped.

Further, in the waiting operation at Step 23, the control part 45 stops the revolution drive part 48. By virtue of this, the revolution of the cutting blades 36 is stopped during the conveyance stop for the sheets S so that wearing in the cutting blades 36 is suppressed.

Then, in the waiting operation at Step 23, the control part 45 does not drive the elevating means so that the supply tray 61 is maintained at the supplying position serving as the height where the suction conveyance for the sheets S can be performed. Further, the control part 45 continues the driving of the separation air blowing part 63. Thus, the sheets S on the supply tray 61 is maintained in a state that the sheet S can be supplied immediately when the driving of the suction fan 67 and the drive part 47 for supply is resumed.

The control part 45 judges whether a predetermined amount of precedently ejected ones of the processing articles Q are to be sorted from the subsequent ones of the processing articles Q among the processing articles Q ejected to the stacker part 2 by the conveyance part 4. First, at Step 24, the control part 45 identifies the type of the carrying member installed in the stacker part 2, and then on the basis of the identification result, judges whether the sorting processing on the processing articles Q is to be executed. The control part 45 perform communication with the storage part of the carrying member so as to identify the type of the carrying member. When it is judged that the belt conveyor 86 is installed as the carrying member, the sorting processing is concluded to be executed so that the procedure goes to Step 25.

As such, the control part 45 identifies the type of the carrying member installed in the stacker part 2, and then on the basis of the identification result, judges whether the sorting processing on the processing articles Q is to be executed. Thus, when a carrying member suitable for the sorting processing is installed in the stacker part 2, the sorting processing can automatically be executed so that the convenience is improved.

Here, in the control part 45, even in a case that the belt conveyor 86 is installed in the stacker part 2, when non-execution of the sorting processing is selected by the user, the control part 45 may not execute the sorting processing.

Further, even in a case that the belt conveyor 86 is installed in the stacker part 2, the control part 45 may judge whether the sorting processing is to be executed, on the basis of the sorting information serving as the information related to the sorting processing and imparted to the sheet S. The bar code M2 of the sheet S may contain the sorting information. The sorting information includes: information concerning whether the sorting processing is to be executed; information indicating that the sorting processing is to be executed at a time point that the processing has been completed on a predetermined number of the sheets S after the sheet S provided with the bar code M2; and information indicating that the sorting processing is to be executed at a time point that the processing has been completed on the sheet S provided with the bar code M2.

The read unit 26 acquires the sorting information contained in the various processing information recorded in the bar code M2 and then transmits acquired information to the control part 45. The control part 45, on the basis of the transmitted processing information, controls the individual parts concerning the sorting processing. Then, at Step 24, even when the control part 45 judges that the belt conveyor 86 is installed in the stacker part 2, in a case that non-execution of the sorting processing is selected according to the sorting information imparted to the sheet S, the control part 45 may not execute the sorting processing. In a case that plural pieces of sorting information are present, a priority order of these is stored in advance in any one of the storage device of the processing apparatus D, the bar code M2 of the sheet S, the storage part of the carrying member, and the like.

At Step 25, it is checked whether the processing on all the sheets S in the processing number of sheets has been completed. At a stage that the processing on the five sheets S for the person A's name cards has been completed, Step 25 is satisfied so that the procedure goes to Step 26. At Step 26, the control part 45 controls the driving of the conveyor driving part 40 so as to execute the sorting processing. The control part 45 controls the driving of the conveyor driving part 40 such that the running speed of the belt conveyor 86 may be changed into a predetermined sorting speed.

When the person A's name cards are to be carried on the belt 85, the control part 45 causes the belt 85 to run in a circulated manner at a predetermined carrying speed, so that the person A's name cards can be stacked together on the placement surface in a slightly deviated manner from each other. Then, when the sorting processing at Step 26 is performed, the control part 45 causes the belt 85 to run at a predetermined sorting speed. When the sorting speed is set faster than both of the ejection speed of the processing articles Q to the stacker part 2 and the carrying speed, the precedent ones and the subsequent ones of the processing articles Q processed in the sorting processing can be placed in a short time with a sufficient interval as shown as the processing articles Q1 and Q2 in FIG. 1, so that the sorting can more reliably be performed. Further, the stacker part 2 includes the placement part 83 constructed such that the processing articles Q can be sorted and placed at different positions on the placement surface. Thus, the sorting can easily be achieved on the placement part 83. Further, the placement part 83 includes the belt conveyor 86 constructed such that the processing articles Q are carried on the belt 85 running in a circulated manner. Thus, the sorting can easily be performed on the belt conveyor 86.

On the other hand, when the sorting speed is set slower than the carrying speed, even in a case that the processing articles are stacked high by a reason that the number of sheets of the sorted processing articles is large or each thickness is large, the sorted processing articles can appropriately be conveyed. Thus, a situation can be avoided that when the belt conveyor 86 stops, the processing articles Q stacked high falls so that the carried state and the sorting are disordered.

As such, the control part 45 has been provided for controlling the stacker part 2 such as to sort a predetermined amount of precedently ejected ones of the processing articles Q from the subsequent ones of the processing articles Q among the processing articles Q ejected to the stacker part 2 by the conveyance part 4. Thus, the sheets S can appropriately be managed so that the workability is improved. Further, the control part 45 stores into the storage device the sorting information serving as the information concerning the sorting processing on the processing articles Q in the stacker part 2. Thus, when the information stored in the storage device is read out and then setting is performed, the sorting processing can be performed by using the information stored in the storage device so that the user's convenience is improved.

At step 26, at the time of the sorting processing on the processing articles Q, the control part 45 controls the conveyance part 4 such as to stop the ejection operation for the processing articles Q to the stacker part 2. By virtue of this, the sorting processing can appropriately be performed. During the conveyance by the conveyance part 4 is stopped, when necessary, before the operation of resuming the subsequent processing, the user may perform the work of collecting the processing articles Q ejected to the stacker part 2 so that the processing articles Q can be removed from the placement part 83.

After the sorting processing at Step 26 or, alternatively, in a case that Step 25 is not satisfied, the procedure goes to Step 27. At Step 27, the control part 45 stops the conveyor driving part 40 so as to stops the running of the belt conveyor 86. After the stop of the belt conveyor 86 at Step 27 or, alternatively, in a case that the belt conveyor 86 is not installed as the carrying member at Step 24 so that Step 24 is not satisfied, the procedure goes to Step 28.

At Step 28, when the user has performed the operation of stopping the waiting operation of the processing apparatus D by using the operation panel 46, the procedure goes to Step 33. When the stopping operation at Step 28 is not performed, the procedure goes to Step 29.

At Step 29, it is judged whether a predetermined stop time has elapsed in a state that no operation of the operation panel 46 is performed by the user. The stop time indicates a time set up in advance for stopping the operation of the processing apparatus D. For example, the stop time may be set to be 5 minutes or the like measured from the time point of starting the waiting operation. Further, when necessary, the reference point for the measurement of the stop time may be set at the time point of starting the sorting processing, the time point of completion of the sorting processing, or the like.

At Step 29, when the stop time has elapsed, the procedure goes to Step 33. At Step 29, when the stop time has not yet elapsed, the procedure goes to Step 30. At Step 30, the control part 45 judges whether the processing of the same processing contents as the last processing information is to be resumed. In a case that the user inputs and sets up through the operation panel 46 the number of sheets S to be processed next without changing the last processing information and then performs the operation of processing start, the control part 45 judges that the processing is to be succeedingly performed on the basis of the same processing information as the last processing pattern.

As such, in a case that the user performs solely the setting of the number of sheets of the processing without newly inputting or reading out the processing information and then performs the operation of processing start, the control part 45 need not move each cutting blade 36 to a differ position in the width direction. Thus, in a state that the last cutting position is maintained, the supply of the sheet S waiting on the supply tray 61 can immediately be started so that the next processing can succeedingly be executed. Thus, the operation of moving the supply tray 61 and the cutting blades 36 can be omitted so that the processing time can be reduced. Further, since the unnecessary movement of the cutting blades 36 is avoided, the precision in the processing articles Q can be improved.

When the operation of resumption is performed at Step 30, the procedure goes to Step 31 so that it is judged whether the fullness detecting part 30 has found the fullness. When the stacker part 2 is not yet full and hence the fullness detecting part 30 does not find the fullness, the procedure returns to Step 14 in FIG. 12 so that the next processing is executed.

At Step 31, when the fullness detecting part 30 has found the fullness, the procedure returns to Step 28. Then, Steps 28 to 31 are repeated until the user removes the processing articles Q from the stacker part 2. In this situation, the system stays in the state of waiting operation. Then, when the user performs stopping operation at Step 28 or, alternatively, when a predetermined stop time has elapsed at Step 29 in a state that the user does not removes the processing articles Q from the stacker part 2, the procedure goes to Step 33.

In the course of the waiting operation performed when the stacker part 2 has found the fullness, when the user removes the processing articles Q from the stacker part 2 and then the user performs the operation of resumption of the processing, Step 30 is satisfied so that the procedure goes to Step 31. At Step 31, the fullness detecting part 30 does not find the fullness and hence Step 31 is not satisfied. Thus, the procedure returns to Step 14 in FIG. 12 so that the remaining processing is executed. At Step 16 after the returning to Step 14, a remainder is present in the processing number of sheets so that the procedure goes to Step 18. The processing number of sheets to be set up at Step 18 is the remaining number of sheets held at Step 21. As such, the waiting operation is executed when the stacker part 2 becomes full. Thus, the processing can immediately be resumed when the processing articles Q have been removed from the stacker part 2.

When the operation of resumption is not performed at Step 30, the procedure goes to Step 32. At Step 32, it is judged whether a predetermined resumption time has elapsed. The resumption time is not based on the manual operation by the user like the setting of the number of sheets and the operation of resumption of the processing and, instead, is set up in advance in order that the same processing may automatically be resumed. Until the predetermined resumption time has elapsed, Step 32 is not satisfied and hence the procedure returns to Step 28. For example, the control part 45 controls the conveyance part 4 such that after a predetermined resumption time of 3 minutes has elapsed since a timing selected from the time point of start of the waiting operation at Step 23, the time point of start or termination of the sorting processing at Step 26, and the like, the ejection operation for the subsequent processing articles Q to the stacker 2 part may automatically be resumed. According to a configuration that automatic processing resumption can be set up as described here, when the user desires, the processing can be resumed without performing through the operation panel 46 the operation of resumption of the processing, so that the convenience is improved.

The resumption time judged at Step 32 is set shorter than the stop time at Step 29. When the resumption time is shorter than the stop time, the operation of the processing apparatus D can automatically be stopped at the time that the stacker part 2 becomes full. After the fullness detecting part 30 has found the fullness of the stacker part 2, when a predetermined resumption time has elapsed in a state that the user does not perform manual operation, Step 32 is satisfied so that the procedure goes to Step 31. At Step 31, the stacker part 2 is still full. Thus, Step 31 is satisfied so that the procedure returns to Step 28. After the resumption time has elapsed, Step 29 is not satisfied until the stop time has elapsed. Thus, Steps 28 to 32 are repeated. Then, when the stop time has elapsed, Step 29 is satisfied so that the procedure goes to Step 33.

As such, even when the stacker part 2 has become full, preparation operation for the operation termination is not immediately performed and hence the waiting operation is executed for the predetermined stop time. By virtue of this, the user can remove the processing articles Q from the stacker part 2 during the waiting operation. Then, after the fullness of the stacker part 2 has been resolved, the same processing can immediately be resumed without the operation termination preparation action. Further, when the user is not recognizing the fullness of the stacker part 2, transition to the preparation for the operation termination can automatically be achieved when the stop time has elapsed. By virtue of this, a situation can be avoided that the system is left in the state of waiting operation for a long time. Thus, the power consumption can be reduced.

Similarly to Step 5 in FIG. 7, in the termination preparation at Step 33, the control part 45 controls the elevating means so as to lower the supply tray 61. Further, the separation air blowing part 63 is stopped. At that time, the control part 45 does not drive the processing member movement drive part and hence does not move the cutting blades 36 from the last processing position to the reference position so that the processing position is maintained. When the termination preparation at Step 33 is completed, the procedure is completed so that the operation of the processing apparatus D is stopped.

Second Embodiment

In the first embodiment given above, the sorting processing on the processing articles Q has been performed by the unit of setting number of sheets S. In the present second embodiment, the sorting processing is performed in accordance with the number of sheets of the processing articles Q ejected to the stacker part. In the first embodiment given above, for example, at the time that 100 sheets of person A's name cards are fabricated by using the processing apparatus D, 21 sheets of name cards can be fabricated from one sheet S like in the processing pattern shown in FIG. 6. In this situation, when the name and the like of the person A alone are printed on all five sheets S, five sheets S each for 21 name cards are processed and hence 105 name cards can be fabricated. However, 100 name cards are merely required. Thus, the person A's name and the like may be printed only for the amount of 100 sheets of person A's name cards and then the name and the like of the person B may be printed in the extra portions so that the person B's name cards may be fabricated. According to this processing, the sheet S itself, the time and effort, and the like can be saved.

Figure 14:
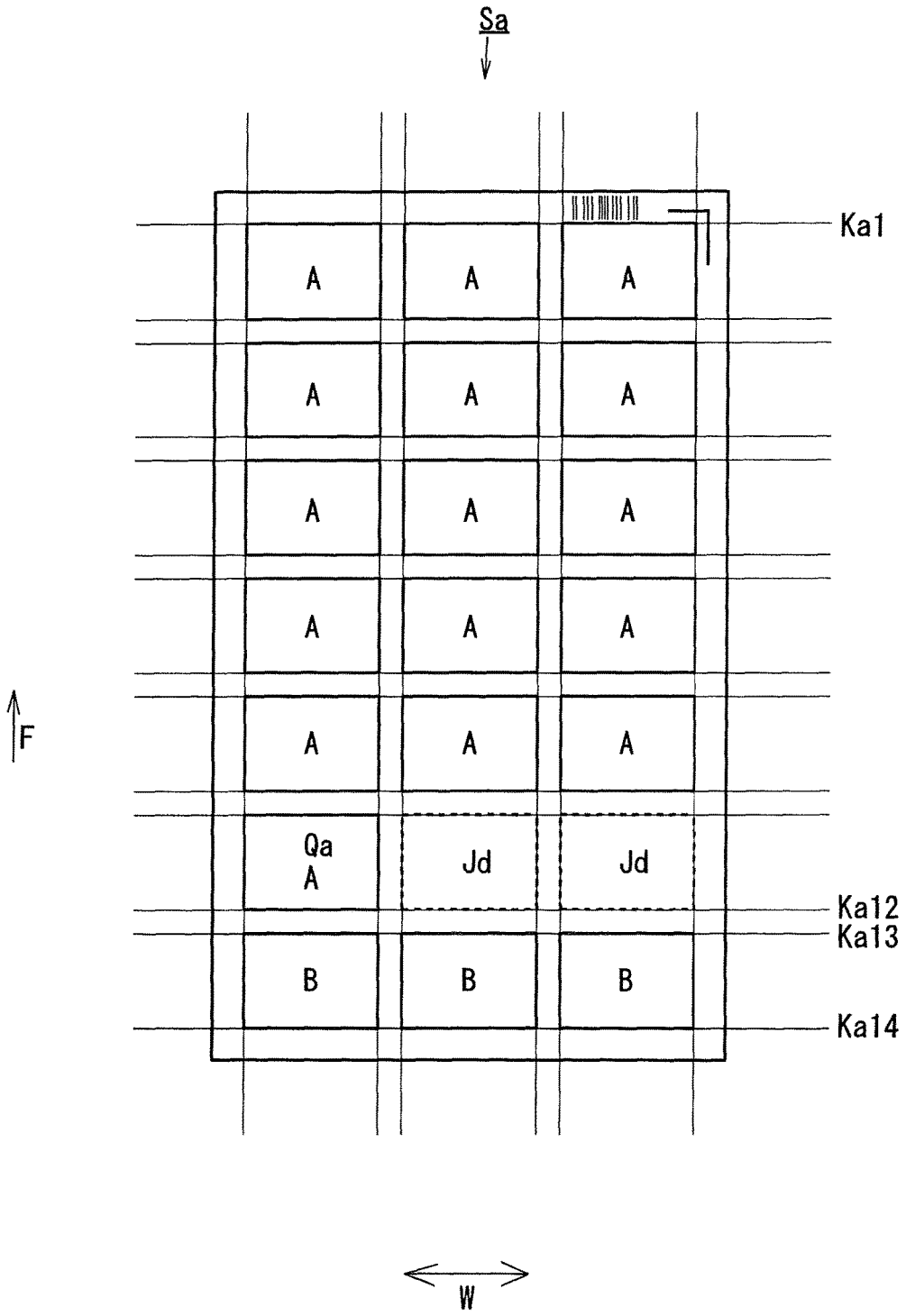
FIG. 14 is a plan view showing another example of a processing pattern of a sheet.

FIG. 14 shows an example of the processing pattern of the fifth sheet Sa in a case that 100 sheets of person A's name cards are to be fabricated as described above. In the sheet Sa, the processing articles Qa whose shapes and sizes are identical to each other are set up in seven rows along the conveyance direction F of the sheet Sa by three columns along the width direction W perpendicular to the conveyance direction F. The processing article Qa located at the sixth row in the conveyance direction F in FIG. 14 and at the left end, or the first column, in the width direction W corresponds to the 100th sheet of the person A's name cards. In the one row of the sheet Sa located on the most downstream side in the conveyance direction F, the person B's name and the like are printed and hence the person B's name cards can be fabricated by the processing.

The processing article Qa is not set up at the positions indicated by dashed lines and located at the center and the right end which are located at the sixth row in the conveyance direction F and the second and the third column in the width direction W and which are adjacent to the processing article Qa serving as the 100th sheet of the person A's name cards. Instead, scraps Jd are set up.

For the purpose of sorting for the sheet Sa shown in FIG. 14, in the second embodiment, a scrap dropping mechanism 27*a* indicated by a dashed line is provided between the cutter processing part 22 and the stacker part 2 of the processing apparatus D according to the first embodiment shown in FIG. 1. The scrap dropping mechanism 27*a* includes a plurality of scrap dropping members 271 aligned in the width direction W. Here, in place of the plurality of scrap dropping members 271, one or a plurality of scrap dropping members may be provided in a manner of being movable in the width direction. For example, a configuration may be employed that the scrap dropping members 271 are driven by a scrap dropping drive part (not shown) so as to be moved between the waiting position and an operating position.

The control part causes the scrap dropping drive part to drive the scrap dropping member 271 corresponding to a location in the width direction W where the scrap Jd is generated, to the installation position for the scrap dropping member 271 at a predetermined timing that the scrap Jd reaches. By virtue of this, the scrap dropping member 271 located at the waiting position is moved to an operating position and then excludes the scrap Jd to the downward of the conveyance path 5.

When the sheet Sa having the processing pattern shown in FIG. 14 is to be processed, the user sets up through the operation panel the number of sheets of the processing articles to be obtained by the processing, and then performs the operation of processing start. After the cutting along the cutting line Ka12 shown in FIG. 14 is performed by the cutter processing part 22, the control part controls the conveyance part 4 so as to eject to the stacker part 2 the processing article Qa serving as the 100th sheet of the person A's name cards. At that time, the scraps Jd are conveyed by the conveyance part and then, at a predetermined timing that the scraps Jd reach the installation position of the scrap dropping members 271, the control part drives the scrap dropping drive part. The scrap dropping members 271 installed at the positions corresponding to the center and the right end locations in the width direction W where the scraps Jd are generated are moved from the waiting position to the operating position so as to exclude the scraps Jd to the downward of the conveyance path 5.

When the processing article Qa serving as as the person A's name card are accumulated on the precedent ones of the person A's name cards on the placement surface, the control part stops the driving of the conveyance drive parts 41 to 44 so as to stop the conveyance of the sheet Sa. As a result, the processing operation on the subsequent sheet Sa for the person B's name cards is suspended. At that time, in a case that a subsequent sheet Sa for the person B's name cards is under conveyance in the inside of the apparatus body 1, the conveyance and the processing are suspended for all sheets Sa including the above-mentioned subsequent sheet Sa for the person B's name cards.

Then, in order that the person A's name cards may be sorted from the subsequently processed person B's name cards, the control part 45 causes the belt 85 to run at a predetermined sorting speed. The person A's name cards are moved to the downstream by a predetermined amount so as to be carried with an interval from the subsequently processed person B's name cards. After that, the processing on the sheet Sa for the person B's name cards having been suspended is resumed. By virtue of this, the sorting can more reliably be performed.

Third Embodiment

Figure 15:
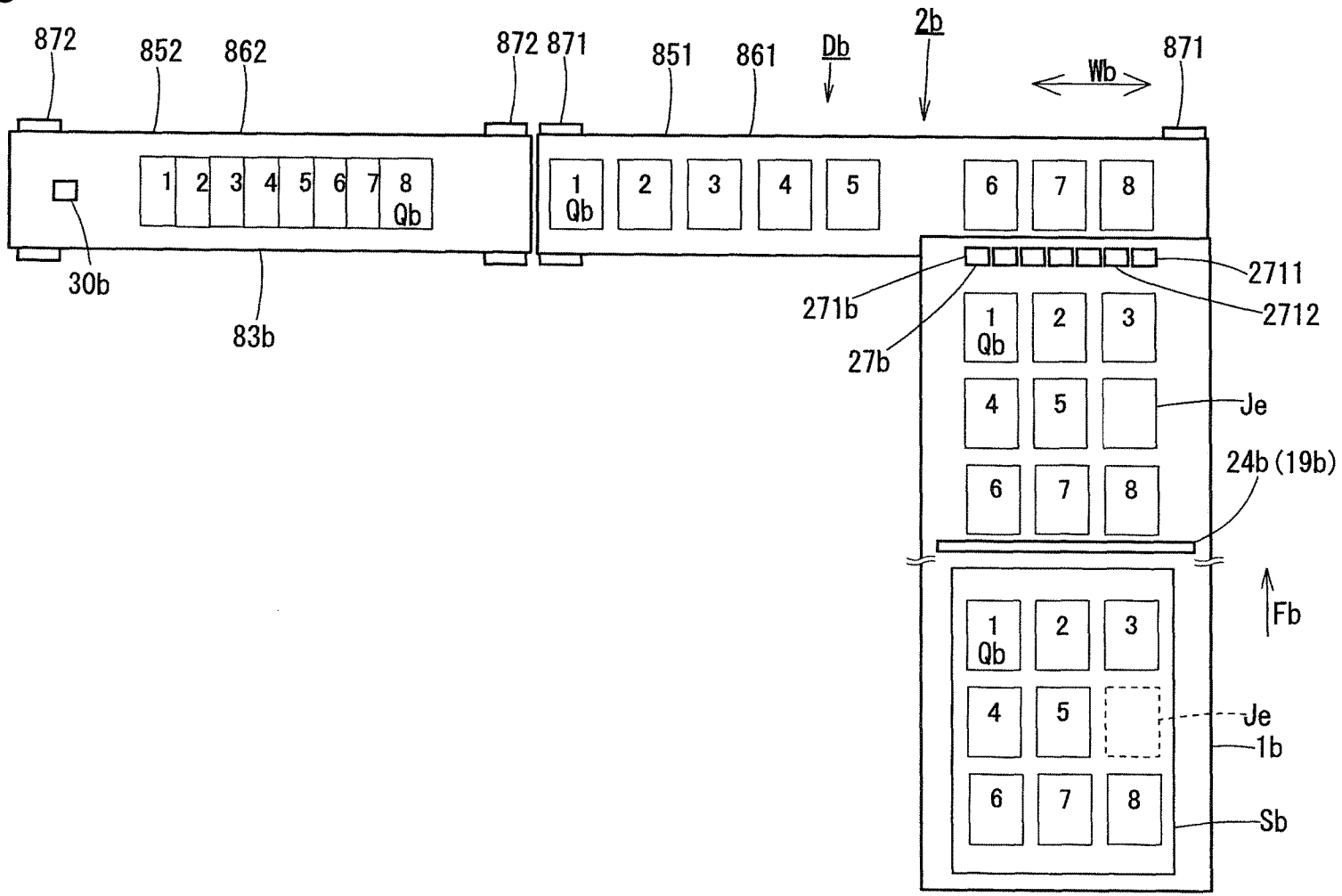
FIG. 15 is an explanation diagram for a situation that processing is performed on sheets by using a processing apparatus according to another embodiment of the present invention.

In the processing apparatus D according to the first embodiment shown in FIG. 1, one belt conveyor 86 has been installed in the stacker part 2 as the carrying member. In this case, the belt conveyor 86 has run along the ejection direction of the processing articles Q. Instead, in the third embodiment, the stacker part 2*b* is provided with a plurality of belt conveyors 861 and 862 as the carrying members. Further, the belt conveyors 861 and 862 run in a direction of intersecting with the ejection direction of the processing articles Qb. FIG. 15 is a plan view showing a state that the processing articles Qb are placed on the stacker part 2*b* of the processing apparatus Db according to the third embodiment. The stacker part 2*b* shown in the figure includes the two belt conveyors 861 and 862 consisting of: the first belt conveyor 861 installed near the ejection port for the processing articles Qb; and the second belt conveyor 862 installed in the downstream of the direction of conveyance of the processing articles Qb performed by the first belt conveyor 861.

Both the first and the second belt conveyor 861 and 862 shown in FIG. 15 run in a direction perpendicular to the direction of ejection of the processing articles Qb performed by the conveyance part. The first belt conveyor 861 includes a first belt 851, conveyor rollers 871, and a first conveyor drive part (not shown). The first belt 851 is wound around a pair of the conveyor rollers 871 installed separately from each other by a predetermined amount in a direction perpendicular to the ejection direction of the processing articles Qb. When the first conveyor drive part is driven, one conveyor roller 871 revolves through a power transmission mechanism (not shown) so that the first belt 851 runs.

Similarly to the first belt conveyor 861, the second belt conveyor 862 includes a second belt 852, conveyor rollers 872, and a second conveyor drive part (not shown). The second belt 852 is wound around a pair of the conveyor rollers 872 installed separately from each other by a predetermined amount in a direction perpendicular to the ejection direction of the processing articles Qb. Then, the second belt 852 runs in association with the driving of the second conveyor drive part.

The height of the placement surface of the first belt 851 for the processing articles Qb is set lower than the height of ejection of the processing articles Qb by a predetermined amount. The height of the placement surface of the second belt 852 for the processing articles Qb is set lower than the height of the placement surface of the first belt 851 by a predetermined amount. Thus, the processing articles Qb are conveyed successively to lower positions.

The scrap dropping mechanism 27*b* is installed between the cutting part 19*b* in the most downstream in the apparatus body 1*b* and the stacker part 2*b*. FIG. 15 shows a case that the scrap dropping mechanism 27*b* is installed near the ejection port for the processing articles Qb. In the scrap dropping mechanism 27*b*, a scrap Je is set up only in a part not extending the entirety in both a direction extending from the front end to the rear end in the conveyance direction Fb of the sheets S and a direction extending from the right end to the left end in the width direction Wb. Then, in a case that the scrap Je is cut out from the sheet Sb together with the processing articles Qb by virtue of the processing of the processing part 24*b* and then conveyed to the vicinity of the stacker part 2*b*, the scrap Je having been processed by the processing part 24*b* and then cut out from the sheet Sb is guided into the scrap collecting part 23 located below.

The scrap dropping mechanism 27*b* shown in FIG. 15 includes a plurality of scrap dropping members 271*b* aligned in the width direction WB. Here, in place of the plurality of scrap dropping members 271*b*, one or a plurality of scrap dropping members may be provided in a manner of being movable in the width direction WB. For example, a configuration may be employed that the scrap dropping members 271*b* are driven by a scrap dropping drive part (not shown) so as to be moved between the waiting position and an operating position.

The control part 45 causes the scrap dropping drive part to drive the scrap dropping member 271*b* corresponding to a location in the width direction WB where the scrap Je is generated, to the installation position for the scrap dropping member 271*b* at a predetermined timing that the scrap Je reaches. By virtue of this, the scrap dropping member 271*b* located at the waiting position is moved to an operating position and then excludes the scrap Je to the downward of the conveyance path 5.

As shown in FIG. 15, in the processing pattern of the processing articles Qb according to the third embodiment, the processing articles Qb whose shapes and sizes are identical to each other are set up in three rows along the conveyance direction Fb of the sheet Sb by three columns along the width direction Wb perpendicular to the conveyance direction Fb. However, the scrap Je in place of the processing article Qb is set up at a position indicated by a dashed line in FIG. 15 and located at the center in the conveyance direction Fb and at the right end in the width direction Wb. As a result, eight processing articles Qb in total are set up. Then, these processing articles Qb are designated by consecutive numbers from left to right from downstream to upstream in the conveyance direction in FIG. 15.

The control part causes the stacker part 2*b* to accumulate the processing articles Qb in the order of designated numbers. Then, the control part controls the stacker part 2*b* such as to perform the sorting processing on the processing articles Qb in accordance with the number of ejected sheets of the processing articles Qb ejected to the stacker part 2. In the sheet Sb shown in FIG. 15, at the time point that eight sheets of the processing articles Qb are placed on the first belt 851, the sorting processing is executed so that the processing articles Qb are located in a manner of being separated from the subsequent processing articles Qb by a predetermined amount so that the sorting is achieved.

Figure 16:
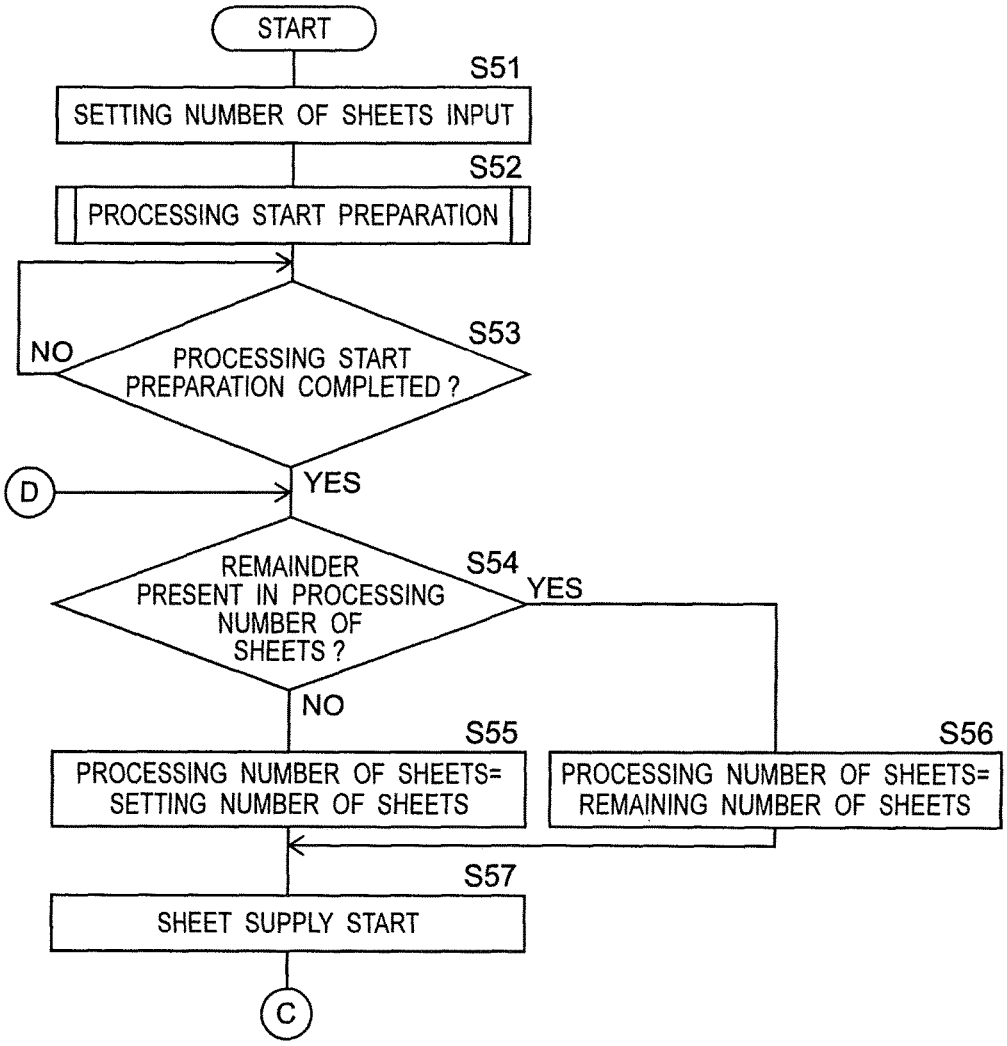
FIG. 16 is a flow chart of processing performed on sheets by the processing apparatus.
Figure 17:
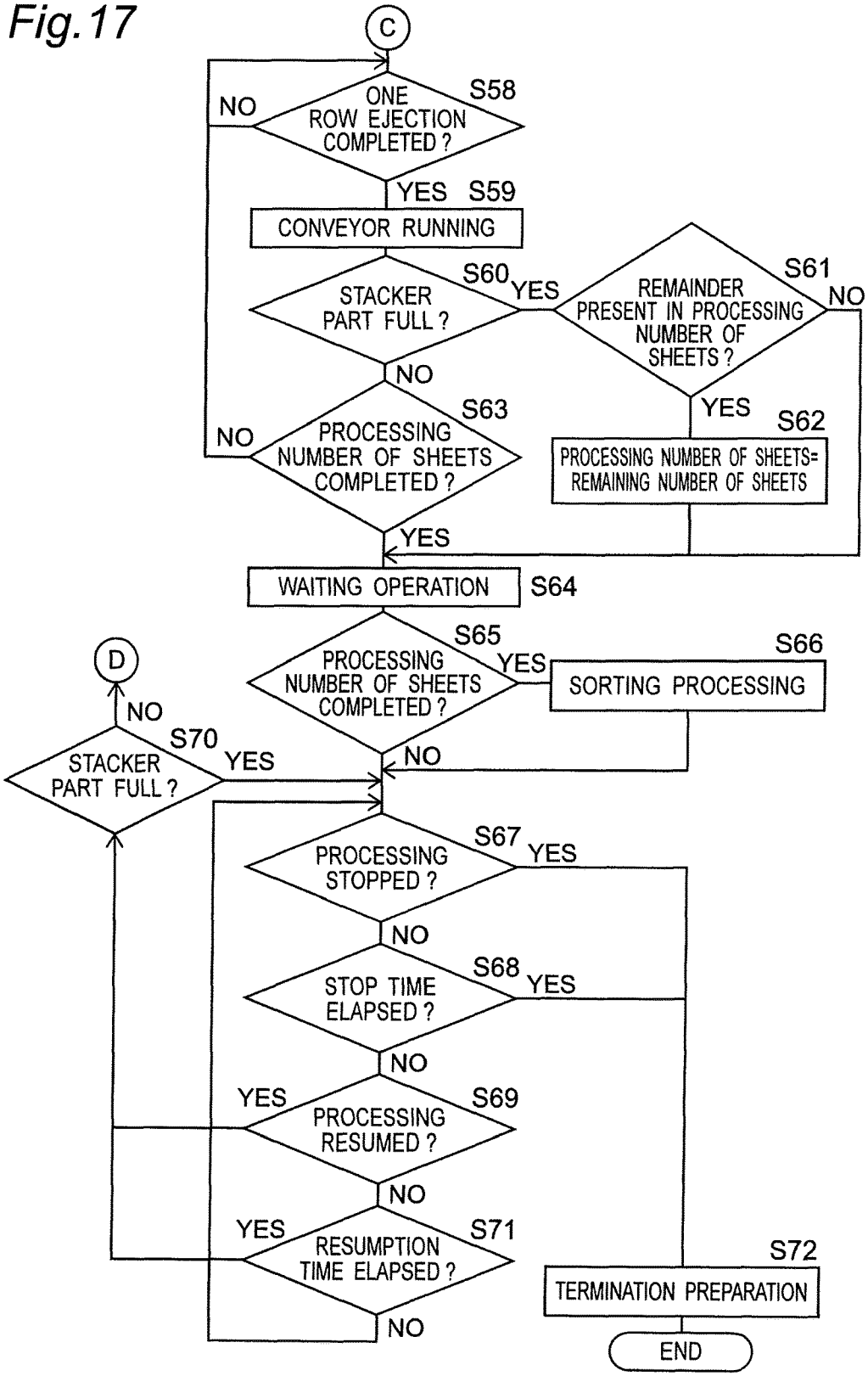
FIG. 17 is a flow chart of processing performed on sheets by the processing apparatus.

The operation of the stacker part 2*b* according to the third embodiment is described below. FIGS. 16 and 17 are flow charts of the third embodiment. Steps 51 to 53 in this figure are the same as Steps 1 to 3 in FIG. 7. At Step 54 is FIG. 16, it is checked whether a remainder is present in the processing number of sheets. When no remainder is present in the processing number of sheets, the procedure goes to Step 55. At Step 55, the processing number of sheets is set equal to the setting number of sheets inputted at Step 51.

At Step 54, when a remainder is present in the processing number of sheets, the procedure goes to Step 56 so that the processing number of sheets is set equal to the remaining number of sheets. The procedure goes to Step 57 so that the supply of the sheet S to the conveyance path 5 is started and then the processing on the sheets S is started. During the time that the processing on the sheet Sb is performed by the processing part 24*b*, the control part does not drive both the first and the second conveyor drive part and hence the running of both the first and the second belt 851 and 852 is stopped.

At Step 58 in FIG. 17, it is judged whether the processing articles Qb1 to Qb3 at the first row in the conveyance direction Fb of the conveyance part in FIG. 15 have been ejected onto the first belt 851. Step 58 is repeated until the ejection of the processing articles Qb1 to Qb3 onto the first belt 851 is completed. Then, when the ejection of the processing articles Qb1 to Qb3 has been completed, the procedure goes to Step 59. At Step 59, the control part drives the first conveyor drive part by a predetermined amount so as to cause the first belt conveyor 861 to run at a predetermined placement speed.

It is preferable that the placement speed is set faster than the ejection speed of the processing articles Qb from the apparatus body 1*b*. The placement speed is set to be a speed in which after the completion of ejection of the processing articles Qb1 to Qb3 onto the first belt 851, until the processing articles Qb4 and Qb5 at the second row go into contact with the placement surface of the first belt conveyor 861, the precedent processing articles Qb1 to Qb3 at the first row can be moved in the width direction Wb by a predetermined placement movement amount. This placement movement amount of the processing articles Qb1 to Qb3 in the width direction Wb by the running of the first belt conveyor 861 is set equal to a predetermined length necessary for realizing a situation that the subsequent processing articles Qb4 and Qb5 are placed adjacent to the precedent processing articles Qb1 to Qb3 with equal intervals on the placement surface.

During the running of the first belt conveyor 861, the running of the second belt conveyor 862 is stopped or, alternatively, the second belt conveyor 862 is caused to run at a slower speed than the first belt conveyor 861. The procedure goes to Step 60 so that it is judged whether the fullness detecting part 30*b* has found the fullness of the stacker part 2*b*. At Step 60 when the fullness detecting part 30*b* has found a situation that the processing articles Qb cannot be placed any more on the second belt conveyor 862, the procedure goes to Step 61.

At Step 61, it is judged whether a remainder is present in the processing number of sheets. At a stage that a part of the set-up number of sheets have been processed, in a case that a situation has been found that the second belt conveyor 862 serving as the stacker part 2*b* has become full, Step 61 is satisfied so that the procedure goes to Step 62. At Step 62, the processing number of sheets is set equal to the remaining number of sheets. In a case that the processing on a number of sheets exactly equal to the set-up number of sheets has been completed at the time that the second belt conveyor 862 has become full, this situation indicates that no remaining number of sheets is present in the processing number of sheets at Step 61. Thus, Step 61 is not satisfied so that the procedure goes to Step 64.

At Step 60, when it is judged that the stacker part 2*b* is not yet full, Step 60 is not satisfied so that the procedure goes to Step 63. At Step 63, it is judged whether the processing number of sheets have been completed. At a stage that the first row has been ejected and then the first belt conveyor 861 has run by a predetermined placement movement amount, the processing number of sheets are not yet completed. Thus, Step 63 is not satisfied so that the procedure returns to Step 58. At Step 58, it is judged whether the processing articles Qb4 and Qb5 at the second row have been ejected onto the first belt 851.

At the time that the processing articles Qb4 and Qb5 at the second row pass through the installation position of the scrap dropping members 271*b*, the control part drives and controls the scrap dropping drive part such as to move the two scrap dropping members 2711 and 2712 shown in the right end part in FIG. 15. When the scrap dropping members 2711 and 2712 move from the waiting position to a predetermined operating position where the scrap Je can be dropped, the scrap Je are excluded to the downward of the conveyance path 5.

After that, the processing articles Qb4 and Qb5 remaining on the conveyance path 5 and being conveyed to the downstream is ejected onto the first belt 851 being stopped. When the ejection of the processing articles Qb4 and Qb5 has been completed, Step 58 in FIG. 17 is satisfied so that the procedure goes to Step 59. At Step 59, the control part drives and controls the first conveyor drive part so as to move again the first belt conveyor 861 by the predetermined placement movement amount. Then, Steps 60 to 63 are executed similarly to the first row.

Similarly to the first and the second row, Steps 58-63 are executed on the processing articles Qb6 to Qb8 at the third row. The processing articles Qb6 to Qb8 at the third row are ejected adjacent to the precedent processing articles Qb4 and Qb5 with a distance equal to the size of the scrap Je excluded by the scrap dropping members 271*b*.

When the eight sheets of processing articles Qb have been ejected and hence the processing number of sheets have been completed, Step 63 is satisfied so that the procedure goes to Step 64. At Step 64, the control part executes the waiting operation.

The procedure goes to Step 65 so that the control part judges whether the processing number of sheets have been completed. At the stage that the eight sheets of processing articles Qb have been ejected, the processing number of sheets have been completed and hence Step 65 is satisfied so that the procedure goes to Step 66. At Step 65, in a case that the stacker part 2*b* is full so that the waiting operation is under execution and hence the processing number of sheets are not yet completed, the sorting processing is not to be executed. Thus, the procedure goes to Step 67.

Prior to the sorting processing at Step 66, the control part drives the first conveyor drive part and the second conveyor drive part so as to, first, move the processing articles Qb1 to Qb8 from the first belt conveyor 861 to the second belt conveyor 862. The running speed of the first belt 851 during the movement between the belt conveyors 861 and 862 is referred to as a first movement speed. Then, the first movement speed is set faster than a second movement speed serving as the running speed of the second belt conveyor 862. As a result, the processing articles Qb having been placed on the first belt 851 sheet by sheet without overlapping with each other are carried on the second belt conveyor 862 running at a lower speed than the first belt conveyor 861, in a slightly deviated manner from each other.

At that time, in order that the plurality of processing articles Qb1 to Qb8 may be placed with equal intervals, after the processing article Qb5 is moved from the first belt 851 onto the second belt 852, the control part stops the second conveyor drive part for a predetermined time so as to stop the running of the second belt 852 for a length correspondence to the size of the scrap Je set up adjacent to the processing article Qb5. By virtue of this, the distance between the processing articles Qb5 and Qb6 on the first belt 851 is reduced so that all processing articles Qb are carried on the second belt 852 with equal intervals in a manner of being separated by the same length. Thus, the workability is improved.

After all processing articles Qb1 to Qb8 have been moved onto the second belt 852, the control part causes the second belt 852 to run by a length necessary for sorting the subsequent processing articles Qb. The running speed of the second belt 852 in the sorting processing may be the same as the second movement speed serving as the running speed of the second belt conveyor 862 employed at the time that the processing articles Qb1 to Qb8 are moved from the first belt conveyor 861 to the second belt conveyor 862, or, alternatively, may be faster than the second movement speed. At the time of the sorting processing, in a case that the second belt conveyor 862 is caused to run faster than at the other timing, so that the time taken in the sorting processing can be reduced.

Step 67 to Step 72 are similar to Steps 28 to 33 of the first embodiment shown in FIG. 13.

Fourth Embodiment

Figure 18:
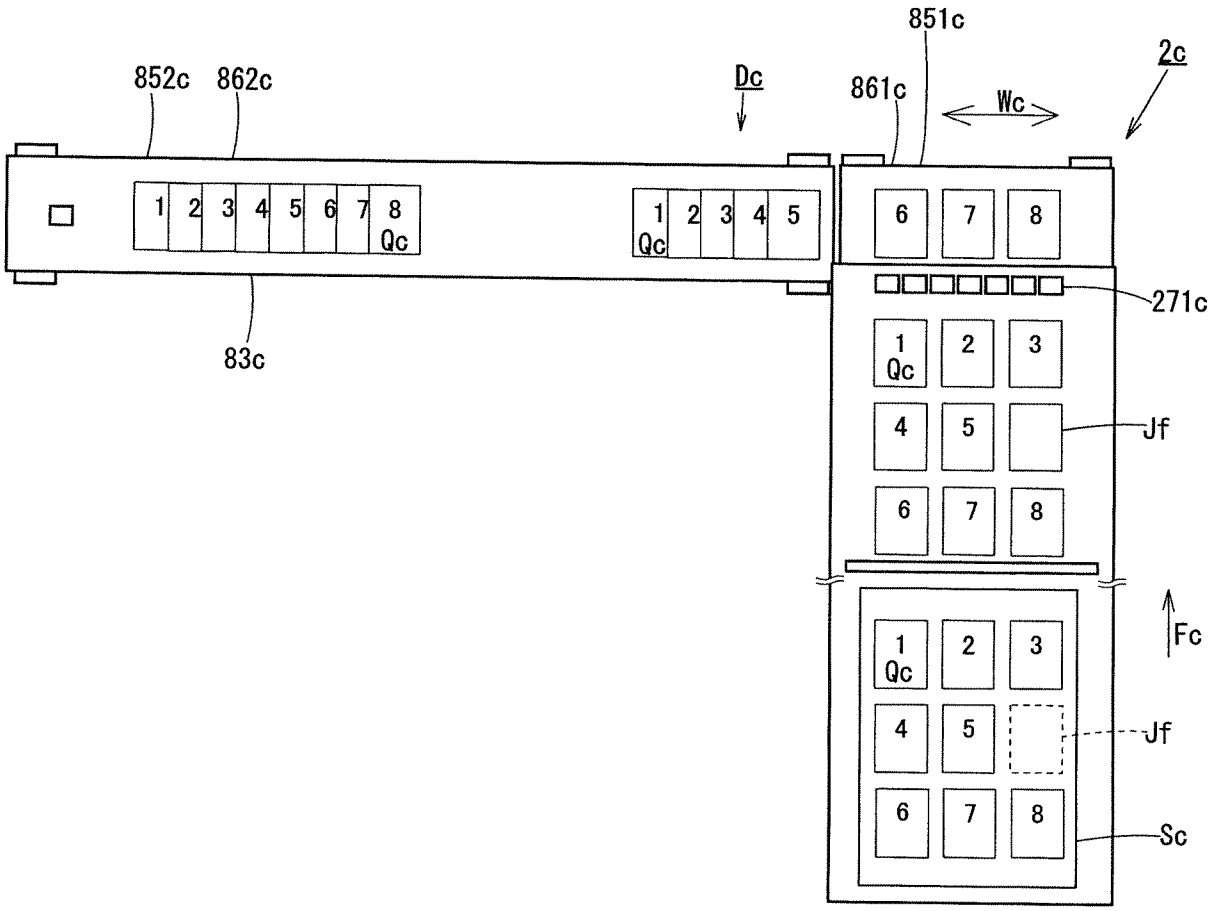
FIG. 18 is an explanation diagram for a situation that processing is performed on sheets by using a processing apparatus according to yet another embodiment of the present invention.

FIG. 18 is a plan view showing a state that the processing articles Qc are placed on the stacker part 2*c* of a processing apparatus Dc according to a fourth embodiment. Similarly to the processing apparatus Db of the third embodiment given above, in the processing apparatus Dc according to the fourth embodiment, the stacker part 2*c* includes a plurality of belt conveyors 861*c* and 862*c* serving as the carrying members and running in a direction intersecting with the ejection direction of the processing articles Qc. The length of the first belt conveyor 861*c* in the running direction is shorter than the first belt conveyor 861 of the third embodiment given above and is substantially the same as the length of the ejection port for the processing articles Qc in the width direction Wc. The second belt conveyor 862*c* is formed longer than the first belt conveyor 861*c*.

In the third embodiment given above, the operation of moving the processing articles Qb1 to Qb8 from the first belt conveyor 861 to the second belt conveyor 862 has been performed at a timing posterior to the completion of the processing of the processing number of sheets and immediately anterior to the execution of the sorting processing. In the present fourth embodiment, after the ejection of the processing articles Qc of one row has been completed at Step 58 in FIG. 17, the processing articles Qc of one row is moved from the first belt conveyor 861 to the second belt conveyor 862. At that time, in the running of the conveyor at Step 59 in FIG. 17, the control part drives the first conveyor drive part by a predetermined amount so as to cause the first belt conveyor 861 to run at a predetermined placement speed. During the running of the first belt conveyor 861, the control part stops the running of the second belt conveyor 862 or, alternatively, causes the second belt conveyor 862 to run at a slower speed than the first belt conveyor 861*c*.

The height of the placement surface of the first belt 851*c* for the processing articles Qc is set lower than the height of the placement surface of the second belt 852*c* for the processing articles Qc by a predetermined amount. Thus, the processing articles Qc are successively dropped from on the first belt 851*c* onto the second belt 852*c*. When the running of the second belt conveyor 862*c* is stopped, the processing articles Qc are stacked at the same position on the placement surface of the second belt 852*c*. When the second belt conveyor 862*c* runs at a lower speed than the first belt conveyor 861*c*, the processing articles Qc of one row having been placed on the first belt 851*c* sheet by sheet without overlapping with each other are stacked together on the placement surface of the second belt 852*c* in a slightly deviated manner from each other.

As such, at each time that the ejection operation on the processing articles Qc of one row is completed, the processing articles Qc of one row are moved from the first belt conveyor 861*c* to the second belt conveyor 862*c*. At the time, also in the fourth embodiment, similarly to the third embodiment, in order that the plurality of processing articles Qc1 to Qc8 may be placed with equal intervals, after the processing article Qc5 is moved from the first belt 851*c* onto the second belt 852*c*, the second conveyor drive part is stopped for a predetermined time. The running of the second belt 852*c* is stopped during a length correspondence to the size of the scrap Jf excluded by the scrap dropping member 271*c* set up adjacent to the processing article Qc5. By virtue of this, the distance between the processing articles Qc5 and Qc6 placed on the second belt 851*c* becomes equal to the intervals of the other processing articles Qc. Thus, all processing articles Qc can be placed in a deviated manner from each other by the same length so that the workability is improved.

Then, when the eight sheets of processing articles Qc have been ejected to the stacker part 2*c* and hence the processing number of sheets have been completed, the control part performs the waiting operation and performs the sorting processing. In the sorting processing, after all processing articles Qc are moved from the first belt 851*c* onto the second belt 852*c*, the control part causes the second belt 852*c* to run by a length necessary for sorting the subsequent processing articles Qc. It is preferable that the running speed of the second belt 852C in the sorting processing is set faster than the running speed of the second belt 852*c* at the time that the processing articles Qc is moved from the first belt 851*c* to the second belt 852*c*. By virtue of this, the time taken in the sorting processing can be reduced and hence the processing on the sheets Sc can efficiently be performed.

Fifth Embodiment

Figure 19:
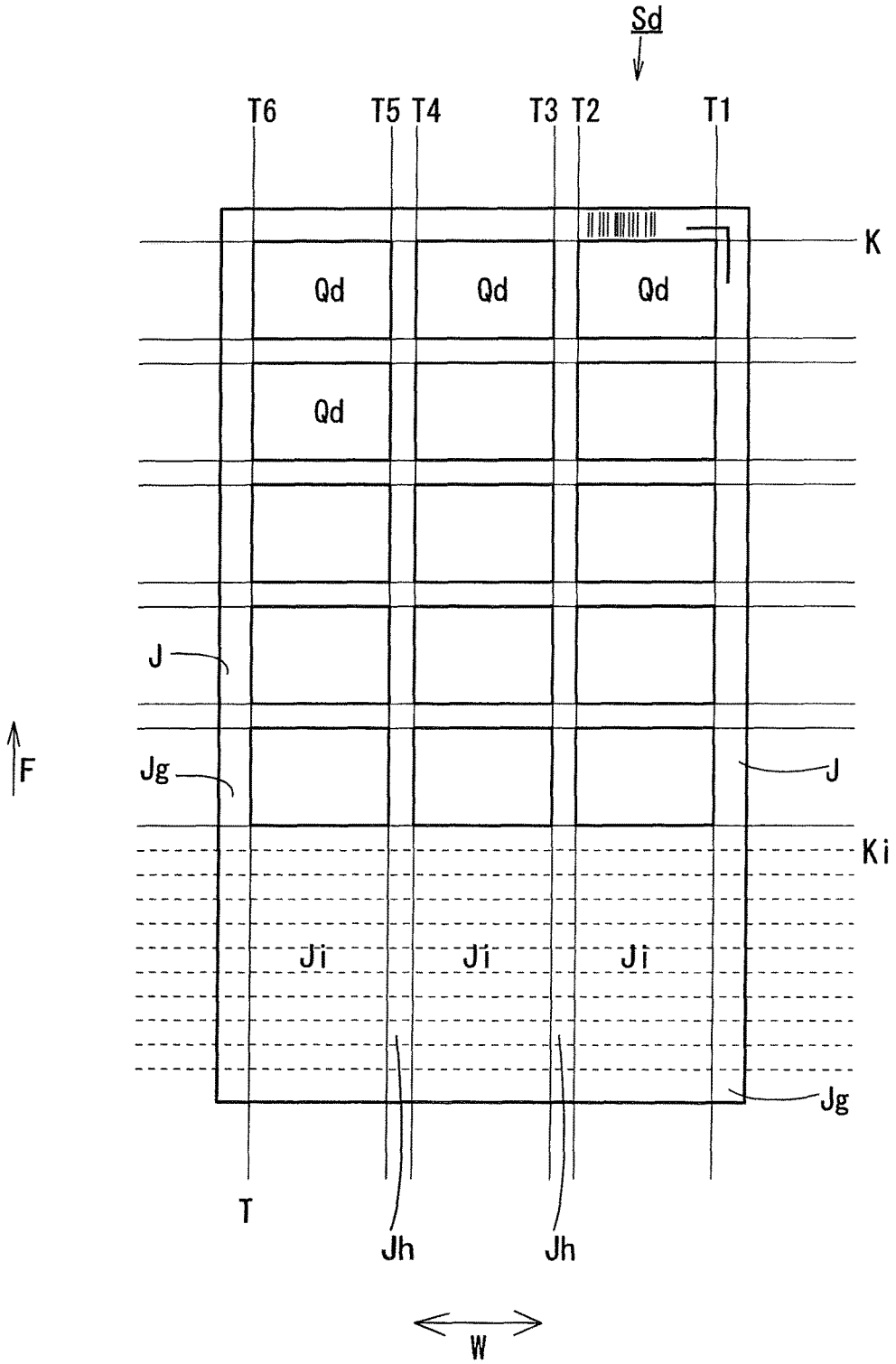
FIG. 19 is a plan view showing yet another example of a processing pattern of a sheet.

In the present fifth embodiment, the processing is performed by using the pattern shown in FIG. 19 in place of the processing pattern of the sheet S shown in FIG. 6 of the first embodiment given above. In the processing pattern of the sheet S shown in FIG. 6, seven rows of the processing articles Q have been set up along the conveyance direction F of the sheet S. In contrast, in the processing pattern shown in FIG. 19, five rows of the processing articles Qd are set up along the conveyance direction F of the sheet S. Thus, the length in the conveyance direction F of the scrap Ji on the rear end side of the sheet S is longer than the scrap Jc on the rear end side of the sheet S shown in FIG. 6.

The scrap Jc on the rear end side of the sheet S shown in FIG. 6 has a short length in the conveyance direction F. Thus, when the sheet S is cut along the width direction W by the cutter processing part 22 so that the cutting line K is formed, the scrap Jc is cut out from the sheet S and then moved downward so as to be guided by the guide 60 and collected by the scrap collecting part 23. However, the scrap Ji shown in FIG. 19 has a longer length in the conveyance direction F than the scrap Jc and hence is not moved downward immediately after the cutting, so as to be retained on the conveyance path 5 in a state of being pinched by the conveyance rollers 16 installed in a vicinity on the upstream side of the cutting blade 69.

In such a scrap Ji, as indicated by dashed lines Ki in FIG. 19, a plurality of extra cutting lines Ki may be formed along the width direction W so that these obtained scraps can be moved downward immediately after the cutting by the cutting blade 69 so as to be excluded from the conveyance path 5.

Further, in another method, without forming the cutting lines Ki, the scrap Ji may be conveyed to the downstream of the cutter processing part 22 and then, at the time of being ejected to the stacker part 2 by the conveyance rollers 17, dropped to the downward of the conveyance path 5 so as to be collected into a scrap collecting part (not shown) installed in the outside of the housing in the downstream of the conveyance rollers 17. In order that the scrap Ji may more easily be dropped, it is preferable that a space between the conveyance rollers 17 and the belt conveyor 86 is set wider than a predetermined value. This avoids a situation that the scrap Ji is placed onto the belt 85.

The length between the conveyance rollers 17 and the belt conveyor 86 is set shorter than a minimum length of the processible processing articles Qd in the conveyance direction F. Then, in a state that the processing articles Qd is ejected to the stacker part 2, the scrap Ji can be excluded from the conveyance path 5. Further, at the time that the scrap Ji are conveyed by the conveyance rollers 17 in the downstream of the cutter processing part 22, when the conveyance speed of the scrap Ji by the conveyance rollers 17 is set slower than that employed at the time of conveying the processing articles Qd, the scrap Ji can more easily be dropped.

In a case that the length of the scrap Ji in the conveyance direction F is longer than the length between the conveyance rollers 17 and the belt conveyor 86, a cutting line Ki along the width direction W may be formed at any position in the scrap Ji so that the scrap Ji can be prevented from being ejected to the stacker part 2. When the number of extra cutting lines Ki formed in the scrap Ji by using the cutting blade 69 is reduced, the durability of the cutting blade 69 can be improved. Further, the time of conveyance stop of the conveyance part 4 for the purpose of the cutting processing can be reduced so that the processing efficiency for the sheets S can be improved.

Sixth Embodiment

Figure 20:
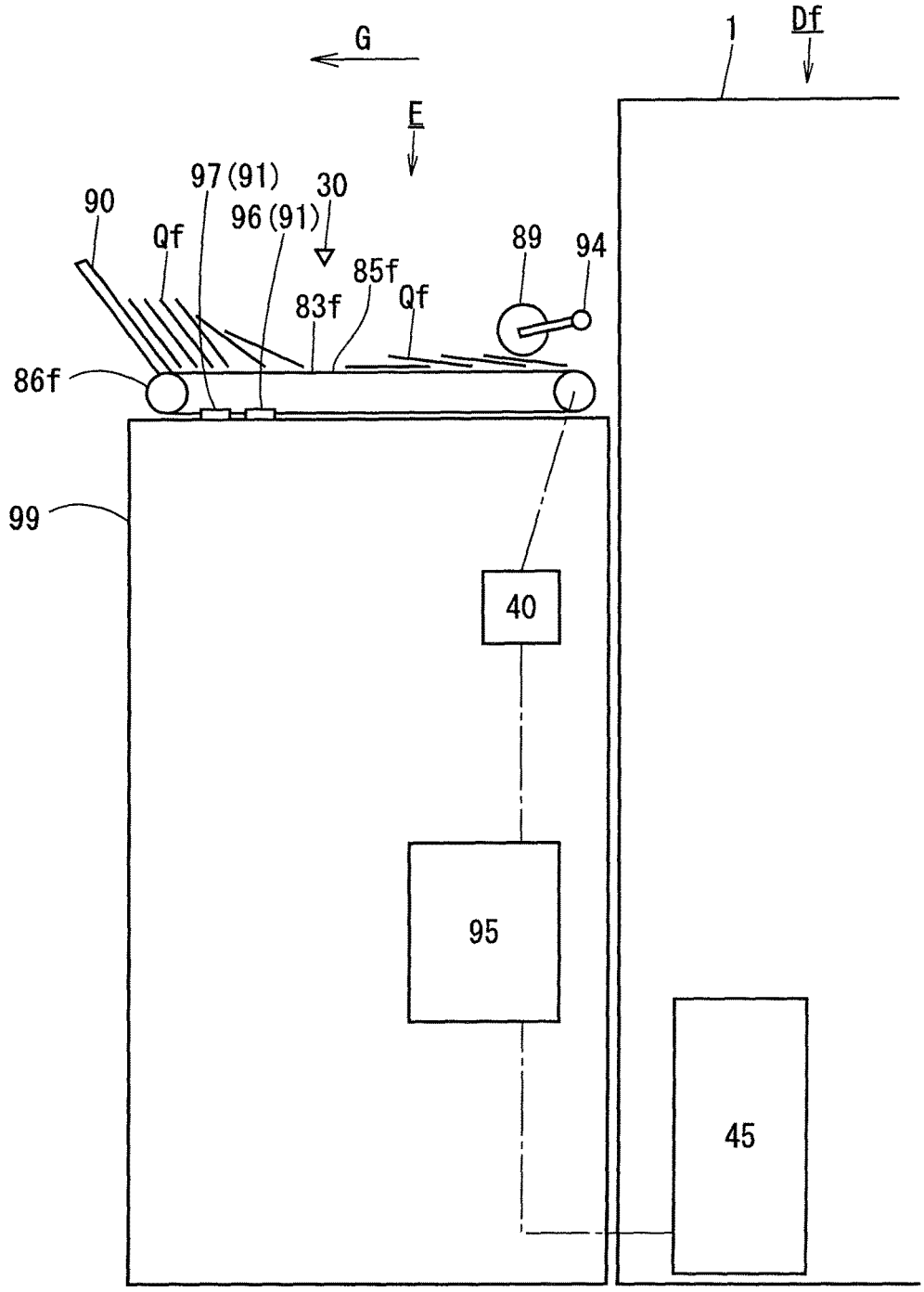
FIG. 20 is a schematic longitudinal sectional view of a stacker device according to the present invention.

FIG. 20 is a schematic longitudinal sectional view showing in an enlarged manner a stacker device E according to the present sixth embodiment. In the first to the fifth embodiment given above, the stacker part 2, 2*b*, or 2*c* has been constructed as a part of the processing apparatus D, Db, or Dc. In contrast, the stacker device E of the sixth embodiment is constructed as apparatus separate from the processing apparatus Df. In addition to the configuration of the stacker part 2 according to the first embodiment shown in FIG. 1, the stacker device E includes a stacker part provided with a pressing roller 89, a pressing roller detection part (not shown), a tilt stopper 90, an operation part 91, and a stacker control part 95.

The pressing roller 89 can go into contact with the placement surface of the belt 85. For example, the pressing roller 89 is constructed such as to swing up and down about a rocking shaft 94 and thereby press the upper face of the processing article Qf by self-weight. Further, in the pressing roller 89, the installation position on the placement surface can be moved in the running direction G of the belt 85. Thus, the pressing roller 89 can be moved to an appropriate position in accordance with the dimension of the processing article Qf.

On the placement surface of the belt 85, the subsequent processing article Qf is stacked on the precedent processing article Qf in a manner of being partly overlapping with each other by a predetermined length.

The pressing roller detection part detects the position of the pressing roller 89 on the placement surface. The pressing roller detection part may be constructed from: a potentiometer; the driving amount meter of a motor (not shown) for moving the pressing roller 89; a line sensor; or the like.

As such, the pressing roller 89 for pressing the processing article Qf is set up and then the installation position of the pressing roller 89 is movable in the running direction G of the belt 85. Thus, the pressing roller 89 can be moved to a position desired by the user so that the working efficiency can be improved. In the control part 45, the position of the pressing roller 89 on the placement surface can be stored into the storage device together with the processing information. Further, in the control part 45, when necessary, the position of the pressing roller 89 detected by the pressing roller detection part may be stored into the storage device together with processing information automatically or in response to manual setting operation by the user.

The tilt stopper 90 is arranged in a tilted manner at a position not disturbing the running of the belt 85 above an end part of the belt 85. The tilt stopper 90 scoops up into a predetermined angle the processing article Qf conveyed by the running of the belt 85 so as to catch the processing article.

The operation part 91 is installed in a vicinity of the belt conveyor 86*f* like on any one of the right and the left side of the belt 85, in front of the tilt stopper 90, and in a side face of the housing 99 of the stacker device E. The operation part 91 is constructed from an operation panel, buttons, switches, ten keys, and the like. The operation part 91 includes a stop operation part 96 and a linkage switching part 97. The stop operation part 96, in response to manual operation by the user, starts or stops at least any one of the conveyance operation on the sheets S performed by the conveyance part 4 of the processing apparatus Df and the processing operation performed by the processing parts 24.

The linkage switching part 97, in response to manual operation by the user, switches whether the operation of the stacker device E is to be linked with the operation of at least any one of the conveyance part 4 and the processing parts 24. When the stop operation part 96 or the linkage switching part 97 of the stacker device E is manually operated by the user, the control part 45 controls the operation panel 46 such that the present situation such as processing suspended, processing resumed, and stacker device E linked operation or independent operation may be displayed on the operation panel 46 of the processing apparatus Df.

The stacker control part 95 controls the operation of the stacker device E. The stacker control part 95 acquires various processing information including the sorting information by means of setting by the user by using the operation part 91, receiving of a signal transmitted from the control part 45 of the processing apparatus Df, or the like. In the stacker control part 95, the acquired various processing information can be stored into the storage device of the stacker control part 95. In a case that the stacker device E is set up such as to operate without linkage with the operation of the supply unit 3, the conveyance part 4, the processing parts 24, and the like of the processing apparatus Df in the upper stage, the stacker control part 95 independently starts the operation on the basis of the acquired various processing information so as to carry the processing articles Qf.

In a case that the stacker device E is set up such as to operate in linkage with the operation of the supply unit 3, the conveyance part 4, the processing parts 24, and the like of the processing apparatus Df in the upper stage, the control part 45 of the processing apparatus Df transmits to the stacker control part 95 a signal concerning the operation of the stacker device E. Then, the stacker control part 95 operates the stacker device E on the basis of the signal received from the control part 45.

The control part 45 of the processing apparatus Df calculates the running time for the belt 85 driven by the conveyor driving part 40, on the basis of: the sorting distance information acquired as the processing information; the sorting information such as the overlap length between the precedent processing article Qf and the subsequent processing article Qf; the dimension of the processing article Qf in the running direction G of the belt 85; and the like. At the time that the running time of the belt 85 is calculated, the control part 45 may additionally use: an environmental temperature and an environmental moisture detected by a detection part (not shown); information concerning the type and the curling easiness of the sheet S acquired from the processing information; information detected by a detection part and indicating whether the sheet S on the conveyance path 5 is curled; and the like. By virtue of this, a more appropriate running time can be calculated.

After the fifth detection part 35 shown in FIG. 1 detects the processing article Q, at a predetermined timing, the control part 45 of the processing apparatus Df transmits to the stacker control part 95 a signal for causing to drive the conveyor driving part 40 so as to start the running of the belt 85. Further, in addition to the transmission of the signal of running start for the belt 85, the control part 45 counts the running time.

The stacker control part 95 controls the conveyor driving part 40 such as to cause the belt 85 to run since the signal of running start is received from the control part 45 until a signal of running stop is received.

When the counted value of running time has reached the calculated optimal value of running time, the control part 45 transmits a signal of running stop to the stacker control part 95. When receiving the signal of running stop, the stacker control part 95 controls the conveyor driving part 40 such as to stop the running of the belt 85.

Here, the control part 45 has transmitted the signals of running start and running stop to the stacker control part 95. However, in place of this, signals of running start and of information concerning the running time may be transmitted. In this case, the stacker control part 92 causes the belt 85 to run in response to the received signal of running start and then counts the running time. Then, when the counted value of running time has reached the received value of the optimal running time, the running of the belt 85 is stopped.

The user can arbitrarily change the running speed of the belt 85 by operating a volume or the like during the processing on the sheets S. By virtue of this, the length of overlap between the processing articles Qf stacked together in a deviated manner from each other on the placement surface can be adjusted into a user's desired amount so that the working efficiency can be improved.

The control part 45 may be constructed such that the running speed of the belt 85 is detected by a speed detection part (not shown). The detected running speed of the belt 85 can be stored into at least any one of the storage device of the processing apparatus Df and the storage device of the stacker device E automatically or in response to manual setting operation by the user. The timing of storing the running speed of the belt 85 into the storage device may be at a time point during the processing operation on the sheets S. However, instead, it is more preferable that the timing is set to be a time point during a situation that the conveyance or the processing on the sheets S is suspended or stopped like the time that the processing on a predetermined number of sheets S has been completed and the time that an error has occurred. This reduces a load on the arithmetic operation.

Further, with checking the placement situation of the processing articles Qf in the stacker device E, the user can change the processing information such as: the overlap length between the processing articles Qf successively stacked together by a predetermined amount; the position of the pressing roller 89; the sorting distance at the time of sorting the processing articles Qf. The operation of changing the processing information can be executed by using the operation part 91 of the stacker device E, the operation panel 46 of the processing apparatus Df, or the like. In the control part 45 of the processing apparatus Df or the stacker control part 95 of the stacker device E, the various processing information after the change can be stored into the storage device together with the other unchanged processing information. When selecting and setting up the various processing information after the change stored in the storage device, the user can perform the sorting by using the same conditions as the last time onto the processing articles Qf placed on the stacker device E.

When the fullness detecting part 30 has found the fullness of the processing articles Qf, the user performs the work of removing the processing articles Qf from the placement part 83*f* and, after that, operates the operation part 91 such as to resume the conveyance of the sheets S so as to resume the processing. Then, in a case that the operation part 91 is installed in the stacker device E, even in a case of a large sized processing apparatus 1, the user at the stacker device E can start or stop the operation of the processing apparatus Df during the work of collecting the processing articles Q. That is, the necessity of going to the installation position of the operation panel 46 of the processing apparatus Df is avoided so that the convenience is improved.

Here, in the embodiments given above, at the time of the sorting processing on the processing articles Q or Qa to Qc, the control part 45 has controlled the conveyance part 4 such as to stop the ejection operation for the processing articles Q or Qa to Qc to the stacker part 2, 2*b*, or 2*c*. In place of this, the sorting processing may be executed without changing the conveyance speed of the conveyance part. Alternatively, the conveyance speed may be changed like the conveyance speed is set slower than the prior-to-the-sorting conveyance speed of the conveyance part. Further, the stacker part 2, 2*b*, 2*c*, or 2*f* has been provided with the placement part 83, 83*b*, 83*c*, or 83*f* constructed such that the processing articles Q or Qa to Qf can be sorted and placed at different positions on the placement surface. Instead, a configuration may be employed that the processing articles cannot be placed at different positions like in a box-shaped card stacker for accommodating the processing articles in the stacker part. In this case, at the time of the sorting processing, the timing of sorting may be notified to the user by using sound or light so that the user may be prompted to collect the processing articles from the stacker part.

Further, the placement part 83, 83*b*, or 83*f* has been provided with the belt conveyor 86, 86*f*, 861, 861*c*, 862, or 862*c* constructed such that the processing articles are carried on the belt 85, 85*f*, 851, 852, 851*c*, or 852*c* running in a circulated manner. However, in place of the belt conveyor, another configuration may be employed like a lift table and a tilting table. Further, at the time of the sorting processing on the processing articles Q or Qa to Qc, the control part 45 has performed control such that the running speed of belt conveyor 86, 861, 861*c*, 862, or 862*c* may be changed. However, the sorting processing may be performed by another method like the running distance or the running time is increased in a state that the running speed is maintained intact. Further, the control part 45 has performed control such that the processing on the sheets S, Sb, or Sc may be terminated after a predetermined time has elapsed since the time point of the sorting processing on the processing articles Q or Qa to Qc. Instead, the waiting operation may be continued. Further, the control part 45 has identified the type of the carrying member installed in the stacker part 2, 2*b*, or 2*c* and then on the basis of the identification result, has judged whether the sorting processing on the processing articles Q or Qa to Qc is to be executed. Instead, a configuration may be employed that the control part does not perform the identification. In this case, a configuration may be employed that the user can input the type of the carrying member through the operation panel.

At the time of the waiting operation, the control part 45 has controlled the processing part such that in a case that the processing position of the processing member is different for the precedent ones and for the subsequent ones of the processing articles Q or Qa to Qc to be processed in the sorting processing, the processing member located at a precedent processing position serving as the processing position for the processing articles to be precedently ejected to the stacker part may be moved to a reference position and then moved from the reference position to a subsequent processing position serving as the processing position for the subsequent ones of the processing articles and then the processing may be executed and such that in a case that the processing position of the processing member is identical for the precedent ones and for the subsequent ones of the processing articles to be processed in the sorting processing, the subsequent processing may be started without moving the processing member located at the precedent processing position. Instead, the processing member may be moved to the reference position at each time of the sorting processing. Further, according to the flow shown in FIGS. 12 and 13 or FIGS. 16 and 17, in a case that the processing position of the processing member is different for the precedent ones and for the subsequent ones of the processing articles Q or Qa~Qc to be processed in the sorting processing, the processing member located at the precedent processing position has been moved to the reference position and then moved from the reference position to the subsequent processing position. Instead, the processing member may be moved from the precedent processing position to the subsequent processing position and then the processing may be executed. In this case, the processing member skips the movement of to the reference position and is directly moved to the subsequent processing position.

Further, the control part 45 has performed control such that in a case that the processing position is different for the precedent ones and for the subsequent ones of the processing articles Q or Qa~Qc to be processed in the sorting processing, the supply tray 61 for supplying the sheets S, Sb, or Sc to the conveyance path may be moved to the waiting position from a supplying position where the sheets S, Sb, or Sc can be supplied to the conveyance path 5 and such that in a case that the processing position is identical for the precedent ones and for the subsequent ones of the processing articles Q or Qa~Qc to be processed in the sorting processing, the processing on the sheets may be started in a state that the supply tray 61 is maintained at the supplying position. Instead, the supply tray may be moved to the waiting position at each time of the sorting processing.

Further, the rejection mechanism 25 has operated on a sheet S whose position mark M1 or bar code M2 is unrecognizable, so that the sheet S has been dropped and collected into the tray 25*a*. Instead, the rejection mechanism may be not activated at the time of execution of the sorting processing. In the sorting processing, maintaining of the processing order is important in some cases like a case that the processing article is a name card and hence the name and the like of a person are printed and a case that page numbers are assigned to the processing articles. In such a case, when a configuration is employed that unrecognizable sheets are rejected and then, on the basis of the inputted setting number of sheets, the processing after the rejection is automatically continued so that the sorting processing is executed, a possibility arises that a processing article in which the name of a different person is printed and which is to be originally sorted into another stack may be mixed in the sorted stack. Alternatively, there is a possibility of missing page of an amount corresponding to the number of rejected sheets. Thus, at the time of the sorting processing, when the rejection function can be canceled automatically or in response to selection by the user so that the rejection mechanism can be not activated, the sorting processing can more appropriately be performed.

Further, the user has inputted the setting number of sheets and then the sorting processing has been executed at the time that the setting number of sheets have been completed. Instead, a configuration may be employed that even when the user does not input the setting number of sheets, the sorting processing can automatically be executed. For example, the sorting timing information among the various processing information recorded in the bar code M2 of the sheet S may contain end mark information indicating that the sorting processing is to be executed immediately after the ejection of the processing article. When the processing article provided with the end mark information is ejected to the stacker part, the control part automatically executes the sorting processing. Further, in another example, the sorting timing information may contain sheet-number instruction information indicating that the sorting processing is to be executed at the time that the instructed sheet-number-th one of the processing articles is ejected to the stacker part. By virtue of this, the sorting processing is executed even when the user does not input the setting number of sheets. Thus, the time and effort can be saved. This also avoids an error in the input of the setting number of sheets performed by the user. Thus, the convenience can be improved.

Further, the various processing information has been inputted by manual user setting through the operation panel 46 or, alternatively, by an automatic manner employing the bar code M2 read by the read unit 26. Instead, the setting may be performed by communication with an external information processing device like an operation terminal such as a personal computer and a PC controller or, alternatively, with an input device. A plurality of arrangement patterns of the sheets may be stored in advance into storage means by manual input through the operation panel and then a pattern may be read out and set up by specifying a number or the like.

Further, the processing apparatus has included the slitter processing parts 20, the cutter processing part 22, and the crease processing part 21. Instead, a cutter processing part including at least any one of the slitter processing part and the cutter processing part may be provided. Thus, it cannot be overemphasized that the present invention is applicable also to: a processing apparatus having a suitable combination of the cutting part and other processing mechanisms (including a perforation line forming mechanism and a die-cutting mechanism); and a processing apparatus in which the numbers of employed processing mechanisms and conveyance rollers are different from the embodiments. Further, employable arrangement patterns of the sheets are not limited to those shown in FIGS. 6, 14, 15, and 18. That is, other various patterns may be set up concerning the numbers of cutting lines T and K and fold lines C.

In the third and the fourth embodiment, in order that the processing articles Qb and Qc may be placed with equal intervals on the second belt 852 or 852*c*, the driving of the second conveyor drive part has been stopped for a predetermined time after the movement of the processing article Qb5 or Qc5 to the second belt 852, 852*c*. Instead, the amount of movement of the first belt performed after the processing articles at the second row have been ejected onto the first belt may be reduced by an amount corresponding to the scrap Je or Jf. By virtue of this, the processing articles on the first belt or the second belt can be located with equal intervals.

DESCRIPTION OF REFERENCE NUMERALS

F conveyance direction
S, Sa, Sb, Sc sheet
Q, Qa, Qb, Qc processing article
2, 2*b*, 2*c* stacker part
4 conveyance part
24 processing part
45 control part
61 supply tray
83, 83*b*, 83*c*, 83*f* placement part
86, 861, 862, 861*c*, 862*c*, 862*f* belt conveyor

What is claimed is:

1. A processing apparatus comprising:

a conveyor for conveying a sheet;

a processing part including a processing member that is installed in a manner of being movable in an intersecting direction of intersecting with a conveyance direction of the conveyor and that performs predetermined processing at a predetermined position of the sheet under conveyance;

a stacker part for accumulating processing articles obtained by the processing of the processing part; and a controller for controlling the stacker part such as to sort a predetermined amount of precedently ejected ones of the processing articles from the subsequent ones of the processing articles among the processing articles ejected to the stacker part by the conveyor;

wherein the controller, at the time of sorting processing on the processing articles, controls the conveyor such as to stop the election operation for the processing articles to the stacker part.

2. The processing apparatus according to claim 1, wherein the controller controls the stacker part such as to perform the sorting processing on the processing articles in accordance with a number of ejected sheets of the processing articles ejected to the stacker part.

3. The processing apparatus according to claim 1, wherein the stacker part includes a placement part constructed such that the processing articles can be sorted and placed at different positions on a placement surface.

4. The processing apparatus according to claim 1, wherein the controller stores, into a storage device, information concerning the sorting processing on the processing articles performed in the stacker part.

5. The processing apparatus according to claim 1, wherein the sheets are provided with information concerning sorting processing on the processing articles performed in the stacker part, and wherein the controller controls individual ones of the articles on the basis of the information concerning the sorting processing.

6. A processing apparatus comprising:

a conveyor for conveying a sheet;

a processing part including a processing member that is installed in a manner of being movable in an intersecting direction of intersecting with a conveyance direction of the conveyor and that performs predetermined processing at a predetermined position of the sheet under conveyance;

a stacker part for accumulating processing articles obtained by the processing of the processing part; and a controller for controlling the stacker part such as to sort a predetermined amount of precedently ejected ones of the processing articles from the subsequent ones of the processing articles among the processing articles ejected to the stacker part by the conveyor;

wherein the stacker part includes a placement part constructed such that the processing articles can be sorted and placed at different positions on a placement surface;

the placement part includes a belt conveyor constructed such that the processing articles are carried on a belt running in a circulated manner; and the controller, at the time of the sorting processing on the processing articles, controls a drive part of the belt conveyor such as to change a running speed of the belt conveyor so as to be faster than a carrying speed at which the articles are carried to the stacker part.

7. The processing apparatus according to claim 6, wherein the stacker part is constructed such that a running speed of the belt conveyor can be changed by a user, and wherein the controller stores the changed running speed of the belt conveyor into a storage device.

8. The processing apparatus according to claim 6, wherein the stacker part is constructed such that a running speed of the belt conveyor can be changed by a user, and wherein the controller stores the changed running speed of the belt conveyor into a storage device.

9. The processing apparatus according to claim 6, wherein the controller controls the stacker part such as to perform the sorting processing on the processing articles in accordance with a number of ejected sheets of the processing articles ejected to the stacker part.

10. The processing apparatus according to claim 6, wherein the controller stores, into a storage device, information concerning the sorting processing on the processing articles performed in the stacker part.

11. The processing apparatus according to claim 6, wherein the sheets are provided with information concerning the sorting processing on the processing articles performed in the stacker part, and wherein the controller controls individual ones of the articles on the basis of the information concerning the sorting processing.

12. A processing apparatus comprising:

a conveyor for conveying a sheet;

a processing part including a processing member that is installed in a manner of being movable in an intersecting direction of intersecting with a conveyance direction of the conveyor and that performs predetermined processing at a predetermined position of the sheet under conveyance;

a stacker part for accumulating processing articles obtained by the processing of the processing part; and a controller for controlling the stacker part such as to sort a predetermined amount of precedently ejected ones of the processing articles from the subsequent ones of the processing articles among the processing articles ejected to the stacker part by the conveyor;

wherein the controller, when a predetermined time has elapsed since the time point of sorting processing on the processing articles, controls the conveyor such as to automatically resume an ejection operation for the subsequent ones of the processing articles to the stacker part.

13. A processing apparatus comprising:

a conveyor for conveying a sheet;

a processing part including a processing member that is installed in a manner of being movable in an intersecting direction of intersecting with a conveyance direction of the conveyor and that performs predetermined processing at a predetermined position of the sheet under conveyance;

a stacker part for accumulating processing articles obtained by the processing of the processing part; and a controller for controlling the stacker part such as to sort a predetermined amount of precedently ejected ones of the processing articles from the subsequent ones of the processing articles among the processing articles ejected to the stacker part by the conveyor;

wherein the controller, when a predetermined time has elapsed since the time point of sorting processing on the processing articles, controls the conveyor and the processing part such as to terminate the processing on the sheets.

14. A processing apparatus comprising:

a conveyor for conveying a sheet;

a processing part including a processing member that is installed in a manner of being movable in an intersecting direction of intersecting with a conveyance direction of the conveyor and that performs predetermined processing at a predetermined position of the sheet under conveyance;

a stacker part for accumulating processing articles obtained by the processing of the processing part; and a controller for controlling the stacker part such as to sort a predetermined amount of precedently ejected ones of the processing articles from the subsequent ones of the processing articles among the processing articles ejected to the stacker part by the conveyor;

wherein the stacker part includes plural kinds of carrying members whose carrying methods for the processing articles are different from each other, wherein the carrying members are installed near an ejection port for the processing articles in the apparatus body, and wherein the controller identifies the type of the carrying member installed in the stacker part and then controls the individual parts on the basis of the identification result.

15. A processing apparatus comprising:

a conveyor for conveying a sheet;

a processing part including a processing member that is installed in a manner of being movable in an intersecting direction of intersecting with a conveyance direction of the conveyor and that performs predetermined processing at a predetermined position of the sheet under conveyance;

a stacker part for accumulating processing articles obtained by the processing of the processing part; and a controller for controlling the stacker part such as to sort a predetermined amount of precedently ejected ones of the processing articles from the subsequent ones of the processing articles among the processing articles ejected to the stacker part by the conveyor;

wherein the controller controls the processing part such that in a case that the processing position of the processing member is different for the precedent ones and for the subsequent ones of the processing articles to be processed in the sorting processing, the processing member located at a precedent processing position serving as the processing position for the processing articles to be precedently ejected to the stacker part may be moved to a reference position and then moved from the reference position to a subsequent processing position serving as the processing position for the subsequent ones of the processing articles so as to execute the processing or, alternatively, may be moved from the precedent processing position to the subsequent processing position so as to execute the processing and such that in a case that the processing position of the processing member is identical for the precedent ones and for the subsequent ones of the processing articles to be processed in the sorting processing, the subsequent processing may be started without moving the processing member located at the precedent processing position.

16. A processing apparatus comprising:

a conveyor for conveying a sheet;

a processing part including a processing member that is installed in a manner of being movable in an intersecting direction of intersecting with a conveyance direction of the conveyor and that performs predetermined processing at a predetermined position of the sheet under conveyance;

a stacker part for accumulating processing articles obtained by the processing of the processing part; and a controller for controlling the stacker part such as to sort a predetermined amount of precedently ejected ones of the processing articles from the subsequent ones of the processing articles among the processing articles ejected to the stacker part by the conveyor;

wherein the controller controls a movement drive part of the supply tray such that in a case that the processing position is different for the precedent ones and for the subsequent ones of the processing articles to be processed in the sorting processing, a supply tray for supplying the sheets to the conveyance path may be moved to a waiting position from a supplying position where the sheets can be supplied to the conveyance path and such that in a case that the processing position is identical for the precedent ones and for the subsequent ones of the processing articles to be processed in the sorting processing, the processing on the sheets may be started in a state that the supply tray is maintained at the supplying position.

17. A stacker device comprising a stacker part for accumulating processing articles which are ejected from a processing apparatus provided with a conveyor for conveying a sheet and with a processing part including a processing member that is installed in a manner of being movable in an intersecting direction of intersecting with a conveyance direction of the conveyor and that performs predetermined processing at a predetermined position of the sheet under conveyance and which are obtained by the processing of the processing part, wherein a stacker controller is provided for controlling the stacker part such as to sort a predetermined amount of precedently ejected ones of the processing articles from the subsequent ones of the processing articles among the processing articles ejected by the conveyor;

further comprising a placement part constructed such that the processing articles can be sorted and placed at different positions on a placement surface, wherein the stacker controller controls the placement part such that the placement part may be caused to operate in linkage with the operation of at least any one of the conveyor and the processing part of the processing apparatus; and a switching switch for switching whether the placement part is to be caused to operate in linkage with the operation of at least any one of the conveyor and the processing part of the processing apparatus.

* * * * *